US010631107B2

(12) United States Patent
Thomsen et al.

(10) Patent No.: US 10,631,107 B2
(45) Date of Patent: Apr. 21, 2020

(54) HEARING DEVICE COMPRISING ADAPTIVE SOUND SOURCE FREQUENCY LOWERING

(71) Applicant: Oticon A/S, Smørum (DK)

(72) Inventors: Anders Højsgaard Thomsen, Smørum (DK); Jesper Jensen, Smørum (DK); Thomas Ulrich Christiansen, Smørum (DK)

(73) Assignee: OTICON A/S, Smørum (DK)

( * ) Notice: Subject to any disclaimer, the term of this patent is extended or adjusted under 35 U.S.C. 154(b) by 0 days.

(21) Appl. No.: 16/437,634

(22) Filed: Jun. 11, 2019

(65) Prior Publication Data

US 2019/0379985 A1 Dec. 12, 2019

(30) Foreign Application Priority Data

Jun. 12, 2018 (EP) ..... 18177159

(51) Int. Cl.
*H04R 25/00* (2006.01)

(52) U.S. Cl.
CPC ..... *H04R 25/505* (2013.01); *H04R 2225/43* (2013.01)

(58) Field of Classification Search
CPC ..... H04R 25/505; H04R 2225/43
See application file for complete search history.

(56) References Cited

U.S. PATENT DOCUMENTS 6,115,478 A * 9/2000 Schneider ..... H04R 25/70 381/314
6,236,731 B1 * 5/2001 Brennan ..... H03H 17/0266 381/312

(Continued)

FOREIGN PATENT DOCUMENTS

EP 1 686 566 A2 8/2006
EP 1 686 566 A3 5/2009

(Continued)

*Primary Examiner* — Oyesola C Ojo
(74) *Attorney, Agent, or Firm* — Birch, Stewart, Kolasch & Birch, LLP

(57) ABSTRACT

A hearing device comprises a) an input unit for providing at least one electric input signal representing sound in a frequency sub-band representation, b) an SNR estimation unit for estimating a signal to noise ratio and/or a level estimation unit for estimating a level of said at least one electric input signal, and c) a configurable frequency transposition unit for transposing content of a source frequency sub-band $FB_S$ into a destination frequency sub-band $FB_D$. The contents of the modified destination frequency sub-band is determined as a weighted combination of the contents of the source and destination frequency sub-bands according to the expression c1) $P_{Dmod}=\alpha P_D+\beta P_S$ or c2) $MAG_{Dmod}=\alpha MAG_D+\beta MAG_S$, wherein $P_D$ and $MAG_D$ and $P_{Dmod}$ and $MAG_{Dmod}$ are the unmodified and modified power spectrum and magnitude, respectively, of the destination frequency sub-band, and $P_S$ and $MAG_S$ are the power spectrum and magnitude, respectively, of the source frequency sub-band, and the parameters $\alpha$ and $\beta$ are destination and source band weight factors, respectively, that specify details of the frequency transposition operation. The weight factors $\alpha$ and $\beta$ are determined in dependence of the estimate of signal to noise ratio and/or the estimate of level.

20 Claims, 9 Drawing Sheets

(56) References Cited

U.S. PATENT DOCUMENTS

| | | | | |
|---|---|---|---|---|
| 6,240,192 | B1 * | 5/2001 | Brennan | H04R 25/505 381/312 |
| 8,949,113 | B2 * | 2/2015 | Holmberg | H04R 25/353 704/200.1 |
| 9,980,053 | B2 * | 5/2018 | Kuriger | H04R 25/353 |
| 10,085,099 | B2 * | 9/2018 | Kuriger | H04R 25/554 |
| 2004/0082980 | A1 * | 4/2004 | Mouine | A61N 1/36038 607/48 |
| 2005/0141736 | A1 * | 6/2005 | Beimel | H04R 25/407 381/313 |
| 2010/0185442 | A1 * | 7/2010 | Sato | G10L 19/032 704/222 |
| 2012/0197153 | A1 * | 8/2012 | Kraus | A61B 5/04845 600/545 |
| 2016/0142838 | A1 * | 5/2016 | Thomsen | H04R 25/505 381/314 |
| 2016/0241974 | A1 * | 8/2016 | Jensen | H04R 25/407 |
| 2016/0241975 | A1 * | 8/2016 | Jensen | H04R 25/405 |
| 2017/0127192 | A1 * | 5/2017 | Kuriger | H04R 25/353 |

FOREIGN PATENT DOCUMENTS

| | | | |
|---|---|---|---|
| EP | 2 563 044 | A1 | 2/2013 |
| EP | 2 701 145 | A1 | 2/2014 |
| EP | 3 185 590 | A1 | 6/2017 |
| EP | 3 267 697 | A1 | 1/2018 |
| WO | WO 2014/206491 | A1 | 12/2014 |

* cited by examiner

HEARING DEVICE COMPRISING ADAPTIVE SOUND SOURCE FREQUENCY LOWERING

SUMMARY

A Hearing Device:

In an aspect of the present application, a hearing device, e.g. a hearing aid, adapted to be worn at or in an ear of a user, or adapted to be fully or partially implanted in the head of the user, is provided. The hearing device comprises an input unit for providing at least one electric input signal representing sound in a frequency sub-band representation (k,m), where k and m are frequency and time indices, respectively, an SNR estimation unit for estimating a (target) signal to noise ratio (or other signal quality measure), and/or a level estimation unit for estimating a level, of said at least one electric input signal, or a signal or signals derived therefrom, in said frequency sub-band representation, and a configurable frequency transposition unit for transposing content of a source frequency sub-band $FB_S$ into a destination frequency sub-band $FB_D$ so that the contents of the resulting destination frequency sub-band is determined as a weighted combination of the contents of the source and destination frequency sub-bands according to the expression $$P_{Dmod}=\alpha P_D+\beta P_S$$

or $$MAG_{Dmod}=\alpha MAG_D+\beta MAG_S$$

wherein $P_D$ and $MAG_D$ are the unmodified power spectrum and magnitude, respectively, of the destination frequency sub-band before frequency transposition, $P_S$ and $MAG_S$ are the power spectrum and magnitude, respectively, of the source frequency sub-band, and $P_{Dmod}$ and $MAG_{Dmod}$ are the resulting power spectrum and magnitude, respectively, in the resulting destination sub-band after the frequency transposition, and the parameters $\alpha$ and $\beta$ are destination and source band weight factors, respectively, that specify details of the frequency transposition operation. The configurable frequency transposition unit is configured to determine at least one of said weight factors $\alpha$ and $\beta$ in dependence of said estimate of signal to noise ratio (or other signal quality measure) and/or said estimate of level of said at least one electric input signal, or a signal or signals derived therefrom.

Thereby an improved hearing device may be provided.

The term 'partially implanted in the head of the user' is intended to mean that a part of the hearing device is implanted in the head and a part of the hearing device is not implanted (externally located). An example of such a hearing device may e.g. be a bone-anchored hearing device having an adapter comprising a screw that is implanted (or at least partially implanted) in the skull of the user. The rest of the hearing device (comprising a vibrator controlled by a processor in dependence of incoming sound, e.g. picked up by a microphone) is attached to the adaptor to thereby allow vibration to be transferred from the vibrator to the skull bone.

The source frequency sub-band is denoted $FB_S$ (corresponding to frequency sub-band index $k_S$), and the destination frequency sub-band is denoted $FB_D$ (corresponding to frequency sub-band index $k_D$). The signal to noise ratios of the source and destination frequency sub-bands are denoted $SNR(FB_S)$ and $SNR(FB_D)$, respectively. The levels (magnitudes) of the source and destination frequency sub-bands are denoted $MAG(FB_S)$ and $MAG(FB_D)$, respectively. The power spectra $P_S$ and $P_D$ and the magnitudes $MAG_S$ and $MAG_D$ of the source and destination frequency sub-bands $FB_S$ and $FB_D$, respectively, and the corresponding signal to noise ratios $SNR(FB_S)$ and $SNR(FB_D)$, respectively, may be time dependent, e.g. indicated by time index m: $SNR(FB_S(m))$ and $SNR(FB_D(m))$, respectively. The frequency and time dependence of signal to noise ratios, SNR, signal magnitudes, MAG, and destination and source weight factors $\alpha$ and $\beta$ may in general be indicated by arguments (k,m), and specifically for the destination and source frequency sub-bands as $(k_D, m)$ and $(k_S, m)$, respectively, e.g. $SNR(k_D, m)$ and $SNR(k_S, m)$ for the signal to noise ratios of the destination and source frequency sub-bands, respectively (indicating possible frequency and time dependence).

The input unit may comprise at least one analogue to digital (AD) converter unit to allow said at least one input signal to be provided as digitized samples. The input unit may comprise at least one analysis filter bank to allow said at least one input signal to be provided in a time frequency representation, e.g. as frequency sub-band signals.

The hearing device may be configured to determine at least one of said weight factors $\alpha$ and $\beta$ in dependence of said estimate of signal to noise ratio and/or said estimate of level of said at least one electric input signal or a signal or signals derived therefrom in said destination and/or source frequency sub-bands. The weight factors $\alpha$ and $\beta$ may be determined in dependence of respective estimated signal to noise ratios of said source and/or destination frequency sub-bands. In an embodiment, the weight factors $\alpha$ and $\beta$ are determined in dependence of respective estimated levels of said source and/or destination frequency sub-bands. The destination band weight factor $\alpha$ may be determined in dependence of said estimate of signal to noise ratio and/or said estimate of level of said destination frequency sub-band (e.g. only). The source band weight factor $\beta(k_S, m)$ may be determined in dependence of said estimate of signal to noise ratio SNR and/or said estimate of level MAG of said source frequency sub-band $k_S$ (e.g. only). At least one of said weight factors $\alpha$ and $\beta$ may further be determined in dependence of a measure of modulation, or voice activity, etc. The weight factors $\alpha$, $\beta$ may alternatively be determined or influenced by SNR and/or level (MAG, and possibly by other properties of the electric input signal(s)) in other frequency bands (e.g. neighboring frequency bands) in addition to or as an alternative to said source and destination frequency sub-bands $k_S$, $k_D$.

The hearing device may be configured to determine the source and/or destination frequency sub-band(s) in dependence of characteristics of said at least one electric input signal or a signal or signals derived therefrom. Characteristics of the at least one electric input signal or a signal or signals derived therefrom may e.g. comprise derived (typically frequency dependent, estimated) parameters such as level, SNR, voice activity, modulation, auto-correlation, peakyness, kurtosis, etc.

The source and/or destination frequency sub-band(s) may be pre-determined. The source and/or destination frequency sub-band(s) may be determined in dependence of the user's hearing profile, e.g. an audiogram, possibly with a view to the hearing device used (e.g. its style, and/or its maximum output power and/or feedback properties), e.g. during a fitting session where the hearing device is adapted to a particular hearing profile, and/or user. In such case, 'only' the weight factors, possibly only one of the weight factors' are adaptively determined.

The hearing device may be configured to provide that the configurable frequency transposition unit is activated by an activation input in a specific mode of operation and/or when specific conditions are fulfilled. The specific frequency transposition mode of operation may be configured during fitting of the hearing device to a specific user's needs. In an embodiment, one or more modes of operation different from the specific frequency transposition mode of operation is/are defined, wherein a is equal to one, and (3 is equal to zero (indicating no frequency transposition). In an embodiment, the configurable frequency transposition unit is activated when specific conditions are fulfilled, e.g. regarding characteristics of the at least one electric input signal(s) or of a signal or signals derived therefrom.

In an embodiment, the configurable frequency transposition unit is activated under the specific condition that the estimated signal to noise ratio (SNR) and/or the estimated level ($L_S$) of the source band signal is relatively high, e.g. if $SNR(P_S) \geq 5$ dB and/or if $L_S \geq 55$ dB SPL, AND in case the estimated signal to noise ratio (SNR) and/or the estimated level ($L_D$) of the destination band signal is relatively low, e.g. if $SNR(P_D) \leq 0$ dB and/or if $L_D \leq 30$ dB SPL. In an embodiment, the specific condition is or comprises that a voice is estimated to be present in the source band signal (e.g. based on a binary voice activity detector or based on a voice presence probability estimator exhibiting a probability larger than a minimum value, e.g. 50% for a voice presence probability detector). The activation input may be generated by a user via a user interface, or by a sensor, or by a control unit when certain conditions are fulfilled. The activation input may be preset during fitting or may be associated with a specific program or programs. The activation input may be the weight factors α, β (α equal to one, and β equal to zero, defining an OFF mode of the configurable frequency transposition unit).

In general, $L_S$ and/or $L_D$ are/is frequency dependent. Furthermore, $L_D$ cannot be lower than the internal noise floor, which in turn depends on the microphone(s) in the hearing device. Moreover, it is important to specify the type of dB. Here dB SPL (sound pressure level) has been used. In ANSI S3.5 corresponding values are given in dB spectrum level.

The hearing device may be configured to subject the weight factors α and β to a constraint. In an embodiment, the constraint is that the destination and source weight factors α and β are larger than or equal to zero. In an embodiment the constraint is that the sum of α and β is smaller than or equal to a constant γ. In an embodiment, the constant γ is equal to three or less. In an embodiment, the constant γ is equal to one or less.

In an embodiment, the source band weight factor β is relatively low compared to the destination band weight factor α, e.g. $\beta \leq 0.2*\alpha$ (e.g. β equal to 0 representing no frequency lowering), in case the estimated signal to noise ratio (SNR) and/or the estimated level (L; MAG) of the source band signal is low, e.g. if $SNR(FB_S) \leq -5$ dB (or ≤−2 dB or ≤0 dB) and/or if $L(FB_S) \leq 30$ dB SPL (indicating that there is no significant information to transpose).

In an embodiment, the destination band weight factor α is relatively high compared to the source band weight factor β, e.g. $\alpha \geq 0.8*\beta$, in case the estimated signal to noise ratio (SNR) and/or the estimated level (L) of the destination band signal is high, e.g. if $SNR(FB_D) \geq 0$ dB and/or if $L(FB_D) \geq 55$ dB SPL (indicating that there may be significant information in the destination band that we don't want to override by transposition). If the destination band has a relatively low level (e.g. $L(FB_D) \leq -30$ dB SPL), and relatively low SNR (e.g. $SNR(FB_D) \leq -5$ dB), and the source band exhibits a relatively high SNR (e.g. $SNR(FB_S) \geq 5$ dB), frequency transposition might be relevant (i.e. β>0, e.g. with a relatively high source band weight factor β (e.g. β≥0.6). The destination band weight factor α may be relatively low or medium (e.g. α≤0.4), or relatively high (the value of a is not so important because the level of the destination band is assumed to be low).

The configurable frequency transposition unit may be configured to determine the weight factors α and β under the constraint of a performance goal or a cost function.

The performance goal or cost function may comprise one of a measure $\hat{I}$ of a) listening effort b) sound quality, and c) speech intelligibility.

The hearing device may be configured to determine optimal weight factors α* and β* from a database of known combinations of said weight factors (α, β), said power spectra ($P_D$, $P_S$) and/or magnitudes ($MAG_D$, $MAG_S$) of said destination and source frequency sub-bands, and corresponding values of the chosen measure $\hat{I}$. The values of the chosen measure $\hat{I}$ may be measured or estimated values.

The hearing device may be configured to determine the optimal weight factors α* and β* from a database $D_{FL}$ comprising corresponding values of $P_{D,i}$, $SNR(P_{D,i,x})$, $P_{S,j}$, $SNR(P_{S,j,x})$, i−1, . . . , $N_I$, j=1, . . . , $N_J$, x−1, . . . , $N_X$, where $N_I$, and $N_J$ are the number of different values of destination and source sub-band power spectra, respectively, and $N_X$ is the number of different values of SNR for each power spectrum value $P_D$, $P_S$;

$\alpha^*_{i,j,x}\beta^*_{i,j,x}$, i=1, . . . , $N_I$, j−1, . . . , $N_J$, x=1, . . . , $N_X$;

where the optimal weight factors are determined as the values α* and β* of the weight factors $\alpha_{i,j,x}$ and $\beta_{i,j,x}$ corresponding to a value I(α8, β*, $P_D$, $SNR(P_D)$, $P_S$, $SNR(P_S)$) of the chosen measure $\hat{I}$, e.g. speech intelligibility, that fulfills, e.g. maximizes, the performance goal, and/or, e.g. minimizes, the cost function.

The database may alternatively or additionally (to the power spectra ($P_D$, $P_S$)) comprise corresponding values of magnitudes ($MAG_{D,i}$, $MAG_{S,i}$) of the destination and source frequency sub-bands.

In an embodiment, the hearing device comprises a spectacle frame. The hearing device may e.g. comprise (or be in communication with) a camera for monitoring a size of the users' pupils. In an embodiment, the hearing device comprises one or more electrodes for picking up potentials from the users' brain. In an embodiment, optimal weight factors α* and β* are determined with a view to a present (estimated) cognitive load of the user. The present cognitive load of a user may e.g. be estimated by pupilometry or brainwave signals (e.g. EEG).

The input unit may comprise a beamformer filtering unit configured to spatially filter at least two input signals representing sound in the environment said user, and providing said at least one electric input signal as a beamformed signal. The beamformer filtering unit may be of a generalized sidelobe canceller (GSC) type, e.g. a minimum variant distortionless response (MVDR) beamformer. Ideally the MVDR beamformer keeps the signals from the target direction (also referred to as the look direction) unchanged, while attenuating sound signals from other directions maximally. The generalized sidelobe canceller (GSC) structure is an equivalent representation of the MVDR beamformer offering computational and numerical advantages over a direct implementation in its original form. The at least two input signals may be signals from at least to microphones. The input unit may comprise a microphone array comprising at least two microphones (e.g. three or more) and providing said at least two input signals.

The hearing device may be constituted by or comprise a hearing aid, a headset, an earphone, an ear protection device or a combination thereof. The hearing device may form part of or be mounted on or integrated with a spectacle frame, e.g. together with a number of sensors, such as one or more microphones, e.g. a microphone array, or a camera, or electrodes in contact with the user's skin, when the spectacle frame is mounted on the head of the user.

In an embodiment, the hearing device is adapted to provide a frequency dependent gain and/or a level dependent compression and/or a transposition (with or without frequency compression) of one or more frequency ranges to one or more other frequency ranges, e.g. to compensate for a hearing impairment of a user. In an embodiment, the hearing device comprises a signal processor for enhancing the input signals and providing a processed output signal.

In an embodiment, the hearing device comprises an output unit for providing a stimulus perceived by the user as an acoustic signal based on a processed electric signal. In an embodiment, the output unit comprises a number of electrodes of a cochlear implant or a vibrator of a bone conducting hearing device. In an embodiment, the output unit comprises an output transducer. In an embodiment, the output transducer comprises a receiver (loudspeaker) for providing the stimulus as an acoustic signal to the user. In an embodiment, the output transducer comprises a vibrator for providing the stimulus as mechanical vibration of a skull bone to the user (e.g. in a bone-attached or bone-anchored hearing device).

In an embodiment, the hearing device comprises an input unit for providing an electric input signal representing sound. In an embodiment, the input unit comprises an input transducer, e.g. a microphone, for converting an input sound to an electric input signal. In an embodiment, the input unit comprises a wireless receiver for receiving a wireless signal comprising sound and for providing an electric input signal representing said sound.

In an embodiment, the hearing device comprises a directional microphone system adapted to spatially filter sounds from the environment, and thereby enhance a target acoustic source among a multitude of acoustic sources in the local environment of the user wearing the hearing device. In an embodiment, the directional system is adapted to detect (such as adaptively detect) from which direction a particular part of the microphone signal originates. This can be achieved in various different ways as e.g. described in the prior art. In hearing devices, a microphone array beamformer is often used for spatially attenuating background noise sources. Many beamformer variants can be found in literature.

In an embodiment, the hearing device is a portable device, e.g. a device comprising a local energy source, e.g. a battery, e.g. a rechargeable battery.

In an embodiment, the hearing device comprises a forward or signal path between an input unit (e.g. an input transducer, such as a microphone or a microphone system and/or direct electric input (e.g. a wireless receiver)) and an output unit, e.g. an output transducer. In an embodiment, the signal processor is located in the forward path. In an embodiment, the signal processor is adapted to provide a frequency dependent gain according to a user's particular needs. In an embodiment, the hearing device comprises an analysis path comprising functional components for analyzing the input signal (e.g. determining a level, a modulation, a type of signal, an acoustic feedback estimate, etc.). In an embodiment, some or all signal processing of the analysis path and/or the signal path is conducted in the frequency domain. In an embodiment, some or all signal processing of the analysis path and/or the signal path is conducted in the time domain.

In an embodiment, an analogue electric signal representing an acoustic signal is converted to a digital audio signal in an analogue-to-digital (AD) conversion process, where the analogue signal is sampled with a predefined sampling frequency or rate $f_s$, $f_s$ being e.g. in the range from 8 kHz to 48 kHz (adapted to the particular needs of the application) to provide digital samples $x_n$ (or x[n]) at discrete points in time t, (or n), each audio sample representing the value of the acoustic signal at t, by a predefined number $N_b$ of bits, $N_b$ being e.g. in the range from 1 to 48 bits, e.g. 24 bits. Each audio sample is hence quantized using $N_b$ bits (resulting in $2^{Nb}$ different possible values of the audio sample). A digital sample x has a length in time of $1/f_s$ e.g. 50 μs, for $f_s$=20 kHz. In an embodiment, a number of audio samples are arranged in a time frame. In an embodiment, a time frame comprises 64 or 128 audio data samples. Other frame lengths may be used depending on the practical application.

In an embodiment, the hearing devices comprise an analogue-to-digital (AD) converter to digitize an analogue input (e.g. from an input transducer, such as a microphone) with a predefined sampling rate, e.g. 20 kHz. In an embodiment, the hearing devices comprise a digital-to-analogue (DA) converter to convert a digital signal to an analogue output signal, e.g. for being presented to a user via an output transducer.

In an embodiment, the hearing device, e.g. the microphone unit, and or the transceiver unit comprise(s) a TF-conversion unit for providing a time-frequency representation of an input signal. In an embodiment, the time-frequency representation comprises an array or map of corresponding complex or real values of the signal in question in a particular time and frequency range. In an embodiment, the TF conversion unit comprises a filter bank for filtering a (time varying) input signal and providing a number of (time varying) output signals each comprising a distinct frequency range of the input signal. In an embodiment, the TF conversion unit comprises a Fourier transformation unit for converting a time variant input signal to a (time variant) signal in the (time-)frequency domain. In an embodiment, the frequency range considered by the hearing device from a minimum frequency $f_{min}$ to a maximum frequency $f_{max}$ comprises a part of the typical human audible frequency range from 20 Hz to 20 kHz, e.g. a part of the range from 20 Hz to 12 kHz. Typically, a sample rate $f_s$ is larger than or equal to twice the maximum frequency $f_{max}$, $f_s \geq 2 f_{max}$. In an embodiment, a signal of the forward and/or analysis path of the hearing device is split into a number NI of frequency bands (e.g. of uniform width), where NI is e.g. larger than 5, such as larger than 10, such as larger than 50, such as larger than 100, such as larger than 500, at least some of which are processed individually. In an embodiment, the hearing device is/are adapted to process a signal of the forward and/or analysis path in a number NP of different frequency channels (NP≤NI). The frequency channels may be uniform or non-uniform in width (e.g. increasing in width with frequency), overlapping or non-overlapping.

In an embodiment, the hearing device comprises a number of detectors configured to provide status signals relating to a current physical environment of the hearing device (e.g.

the current acoustic environment), and/or to a current state of the user wearing the hearing device, and/or to a current state or mode of operation of the hearing device. Alternatively or additionally, one or more detectors may form part of an external device in communication (e.g. wirelessly) with the hearing device. An external device may e.g. comprise another hearing device, a remote control, and audio delivery device, a telephone (e.g. a smartphone), an external sensor, etc.

In an embodiment, one or more of the number of detectors operate(s) on the full band signal (time domain). In an embodiment, one or more of the number of detectors operate(s) on band split signals ((time-) frequency domain), e.g. in a limited number of frequency bands.

In an embodiment, the number of detectors comprises a level detector for estimating a current level of a signal of the forward path. In an embodiment, the predefined criterion comprises whether the current level of a signal of the forward path is above or below a given (L-)threshold value. In an embodiment, the level detector operates on the full band signal (time domain). In an embodiment, the level detector operates on band split signals ((time-) frequency domain).

In a particular embodiment, the hearing device comprises a voice detector (VD) for estimating whether or not (or with what probability) an input signal comprises a voice signal (at a given point in time). A voice signal is in the present context taken to include a speech signal from a human being. It may also include other forms of utterances generated by the human speech system (e.g. singing). In an embodiment, the voice detector unit is adapted to classify a current acoustic environment of the user as a VOICE or NO-VOICE environment. This has the advantage that time segments of the electric microphone signal comprising human utterances (e.g. speech) in the user's environment can be identified, and thus separated from time segments only (or mainly) comprising other sound sources (e.g. artificially generated noise). In an embodiment, the voice detector is adapted to detect as a VOICE also the user's own voice. Alternatively, the voice detector is adapted to exclude a user's own voice from the detection of a VOICE.

In an embodiment, the hearing device comprises an own voice detector for estimating whether or not (or with what probability) a given input sound (e.g. a voice, e.g. speech) originates from the voice of the user of the system. In an embodiment, a microphone system of the hearing device is adapted to be able to differentiate between a user's own voice and another person's voice and possibly from NON-voice sounds.

In an embodiment, the number of detectors comprises a movement detector, e.g. an acceleration sensor. In an embodiment, the movement detector is configured to detect movement of the user's facial muscles and/or bones, e.g. due to speech or chewing (e.g. jaw movement) and to provide a detector signal indicative thereof.

In an embodiment, the hearing device comprises a classification unit configured to classify the current situation based on input signals from (at least some of) the detectors, and possibly other inputs as well. In the present context, 'a current situation' is taken to be defined by one or more of a) the physical environment (e.g. including the current electromagnetic environment, e.g. the occurrence of electromagnetic signals (e.g. comprising audio and/or control signals) intended or not intended for reception by the hearing device, or other properties of the current environment than acoustic);

b) the current acoustic situation (input level, feedback, etc.), and c) the current mode or state of the user (movement, temperature, cognitive load, etc.);

d) the current mode or state of the hearing device (program selected, time elapsed since last user interaction, etc.) and/or of another device in communication with the hearing device.

In an embodiment, the hearing device further comprises other relevant functionality for the application in question, e.g. compression, noise reduction, acoustic (and/or mechanical) feedback suppression, etc.

In an embodiment, the hearing device comprises a listening device, e.g. a hearing aid, e.g. a hearing instrument, e.g. a hearing instrument adapted for being located at the ear or fully or partially in the ear canal of a user, e.g. a headset, an earphone, an ear protection device or a combination thereof.

Use:

In an aspect, use of a hearing device as described above, in the 'detailed description of embodiments' and in the claims, is moreover provided. In an embodiment, use is provided in a system comprising one or more hearing aids (e.g. hearing instruments).

A method:

In an aspect, a method of operating a hearing device, e.g. a hearing aid, adapted to be worn by a user at or in an ear of the user, or adapted to be fully or partially implanted in the head of the user is furthermore provided by the present application. The method comprises providing at least one electric input signal representing sound in a frequency sub-band representation (k,m), where k and m are frequency and time indices, respectively, estimating a signal to noise ratio of said at least electric input signal, or a signal or signals derived therefrom, in said time frequency representation, transposing content of a source frequency sub-band $FB_S$ into a destination frequency band $FB_D$ so that the contents of the destination frequency sub-band is determined as a weighted combination of the contents of the source and destination frequency sub-bands according to the expression $$P_{Dmod}=\alpha P_D+\beta P_S$$

or $$MAG_{Dmod}=\alpha MAG_D+\beta MAG_S$$

wherein $P_D$ and $MAG_D$ is the unmodified power spectrum and magnitude, respectively, of the destination frequency sub-band before frequency transposition, $P_S$ and $MAG_S$ is the power spectrum or magnitude, respectively, of the source frequency sub-band, and $P_{Dmod}$ and $MAG_{Dmod}$ is the resulting power spectrum or magnitude, respectively, in the resulting destination sub-band after the frequency transposition, and the parameters $\alpha$ and $\beta$ are destination and source band weight factors, respectively, that specify details of the frequency transposition operation. The method further comprises determining at least one of said weight factors $\alpha$ and $\beta$ in dependence of said estimate of signal to noise ratio and/or said estimate of level of said at least one electric input signal or a signal or signals derived therefrom.

It is intended that some or all of the structural features of the device described above, in the 'detailed description of embodiments' or in the claims can be combined with embodiments of the method, when appropriately substituted by a corresponding process and vice versa. Embodiments of the method have the same advantages as the corresponding devices.

The weight factors α and β may be determined in dependence of said estimate of signal to noise ratio and/or said estimate of level of said at least one electric input signal or a signal or signals derived therefrom in said destination and/or source frequency sub-bands.

The source frequency sub-band and said destination frequency sub-band may be located on each side of a threshold frequency determined in advance of use of said hearing device with a view to a hearing profile of the user. The source frequency sub-band may be located above (at a higher frequency than) the destination frequency sub-band. The source frequency sub-band may be located above the threshold frequency. The destination frequency sub-band may be located below the threshold frequency.

The source frequency sub-band and/or the destination frequency sub-band may determined in advance of use of said hearing device with a view to a hearing profile of the user. A hearing profile may e.g. comprise an audiogram, or other data characterizing a hearing ability of the user.

The source frequency sub-band and/or said destination frequency sub-band may be adaptively determined in dependence of a current electric input signal. In addition to source and destination bands used for adaptive frequency lowering according to the present disclosure (using weight parameters α and β to control the frequency lowering process), other frequency lowering mechanisms may be at play, e.g. fixed source and destination bands with fixed weight factors cf. e.g. US20170127192A1, or fixed or adaptive frequency compression schemes.

A Computer Readable Medium:

In an aspect, a tangible computer-readable medium storing a computer program comprising program code means for causing a data processing system to perform at least some (such as a majority or all) of the steps of the method described above, in the 'detailed description of embodiments' and in the claims, when said computer program is executed on the data processing system is furthermore provided by the present application.

By way of example, and not limitation, such computer-readable media can comprise RAM, ROM, EEPROM, CD-ROM or other optical disk storage, magnetic disk storage or other magnetic storage devices, or any other medium that can be used to carry or store desired program code in the form of instructions or data structures and that can be accessed by a computer. Disk and disc, as used herein, includes compact disc (CD), laser disc, optical disc, digital versatile disc (DVD), floppy disk and Blu-ray disc where disks usually reproduce data magnetically, while discs reproduce data optically with lasers. Combinations of the above should also be included within the scope of computer-readable media. In addition to being stored on a tangible medium, the computer program can also be transmitted via a transmission medium such as a wired or wireless link or a network, e.g. the Internet, and loaded into a data processing system for being executed at a location different from that of the tangible medium.

A Computer Program:

A computer program (product) comprising instructions which, when the program is executed by a computer, cause the computer to carry out (steps of) the method described above, in the 'detailed description of embodiments' and in the claims is furthermore provided by the present application.

A Data Processing System:

In an aspect, a data processing system comprising a processor and program code means for causing the processor to perform at least some (such as a majority or all) of the steps of the method described above, in the 'detailed description of embodiments' and in the claims is furthermore provided by the present application.

A Hearing System:

In a further aspect, a hearing system comprising a hearing device as described above, in the 'detailed description of embodiments', and in the claims, AND an auxiliary device is moreover provided.

In an embodiment, the hearing system is adapted to establish a communication link between the hearing device and the auxiliary device to provide that information (e.g. control and status signals, possibly audio signals) can be exchanged or forwarded from one to the other.

In an embodiment, the hearing system comprises an auxiliary device, e.g. a remote control, a smartphone, or other portable or wearable electronic device, such as a smartwatch or the like.

In an embodiment, the auxiliary device is or comprises a remote control for controlling functionality and operation of the hearing device(s). In an embodiment, the function of a remote control is implemented in a smartphone, the smartphone possibly running an APP allowing to control the functionality of the audio processing device via the smartphone (the hearing device(s) comprising an appropriate wireless interface to the smartphone, e.g. based on Bluetooth or some other standardized or proprietary scheme).

In an embodiment, the auxiliary device is or comprises an audio gateway device adapted for receiving a multitude of audio signals (e.g. from an entertainment device, e.g. a TV or a music player, a telephone apparatus, e.g. a mobile telephone or a computer, e.g. a PC) and adapted for selecting and/or combining an appropriate one of the received audio signals (or combination of signals) for transmission to the hearing device.

In an embodiment, the auxiliary device is or comprises another hearing device. In an embodiment, the hearing system comprises two hearing devices adapted to implement a binaural hearing system, e.g. a binaural hearing aid system.

An APP:

In a further aspect, a non-transitory application, termed an APP, is furthermore provided by the present disclosure. The APP comprises executable instructions configured to be executed on an auxiliary device to implement a user interface for a hearing device or a hearing system described above in the 'detailed description of embodiments', and in the claims. In an embodiment, the APP is configured to run on cellular phone, e.g. a smartphone, or on another portable device allowing communication with said hearing device or said hearing system.

Definitions

In the present context, a 'hearing device' refers to a device, such as a hearing aid, e.g. a hearing instrument, or an active ear-protection device, or other audio processing device, which is adapted to improve, augment and/or protect the hearing capability of a user by receiving acoustic signals from the user's surroundings, generating corresponding audio signals, possibly modifying the audio signals and providing the possibly modified audio signals as audible signals to at least one of the user's ears. A 'hearing device' further refers to a device such as an earphone or a headset adapted to receive audio signals electronically, possibly modifying the audio signals and providing the possibly modified audio signals as audible signals to at least one of the user's ears. Such audible signals may e.g. be provided in the form of acoustic signals radiated into the user's outer ears, acoustic signals transferred as mechanical vibrations to the user's inner ears through the bone structure of the user's head and/or through parts of the middle ear as well as electric signals transferred directly or indirectly to the cochlear nerve of the user.

The hearing device may be configured to be worn in any known way, e.g. as a unit arranged behind the ear with a tube leading radiated acoustic signals into the ear canal or with an output transducer, e.g. a loudspeaker, arranged close to or in the ear canal, as a unit entirely or partly arranged in the pinna and/or in the ear canal, as a unit, e.g. a vibrator, attached to a fixture implanted into the skull bone, as an attachable, or entirely or partly implanted, unit, etc. The hearing device may comprise a single unit or several units communicating electronically with each other. The loudspeaker may be arranged in a housing together with other components of the hearing device, or may be an external unit in itself (possibly in combination with a flexible guiding element, e.g. a dome-like element).

More generally, a hearing device comprises an input transducer for receiving an acoustic signal from a user's surroundings and providing a corresponding input audio signal and/or a receiver for electronically (i.e. wired or wirelessly) receiving an input audio signal, a (typically configurable) signal processing circuit (e.g. a signal processor, e.g. comprising a configurable (programmable) processor, e.g. a digital signal processor) for processing the input audio signal and an output unit for providing an audible signal to the user in dependence on the processed audio signal. The signal processor may be adapted to process the input signal in the time domain or in a number of frequency bands. In some hearing devices, an amplifier and/or compressor may constitute the signal processing circuit. The signal processing circuit typically comprises one or more (integrated or separate) memory elements for executing programs and/or for storing parameters used (or potentially used) in the processing and/or for storing information relevant for the function of the hearing device and/or for storing information (e.g. processed information, e.g. provided by the signal processing circuit), e.g. for use in connection with an interface to a user and/or an interface to a programming device. In some hearing devices, the output unit may comprise an output transducer, such as e.g. a loudspeaker for providing an air-borne acoustic signal or a vibrator for providing a structure-borne or liquid-borne acoustic signal. In some hearing devices, the output unit may comprise one or more output electrodes for providing electric signals (e.g. a multi-electrode array for electrically stimulating the cochlear nerve). In an embodiment, the hearing device comprises a speakerphone (comprising a number of input transducers and a number of output transducers, e.g. for use in an audio conference situation).

In some hearing devices, the vibrator may be adapted to provide a structure-borne acoustic signal transcutaneously or percutaneously to the skull bone. In some hearing devices, the vibrator may be implanted in the middle ear and/or in the inner ear. In some hearing devices, the vibrator may be adapted to provide a structure-borne acoustic signal to a middle-ear bone and/or to the cochlea. In some hearing devices, the vibrator may be adapted to provide a liquid-borne acoustic signal to the cochlear liquid, e.g. through the oval window. In some hearing devices, the output electrodes may be implanted in the cochlea or on the inside of the skull bone and may be adapted to provide the electric signals to the hair cells of the cochlea, to one or more hearing nerves, to the auditory brainstem, to the auditory midbrain, to the auditory cortex and/or to other parts of the cerebral cortex.

A hearing device, e.g. a hearing aid, may be adapted to a particular user's needs, e.g. a hearing impairment. A configurable signal processing circuit of the hearing device may be adapted to apply a frequency and level dependent compressive amplification of an input signal. A customized frequency and level dependent gain (amplification or compression) may be determined in a fitting process by a fitting system based on a user's hearing data, e.g. an audiogram, using a fitting rationale (e.g. adapted to speech). The frequency and level dependent gain may e.g. be embodied in processing parameters, e.g. uploaded to the hearing device via an interface to a programming device (fitting system), and used by a processing algorithm executed by the configurable signal processing circuit of the hearing device.

A 'hearing system' refers to a system comprising one or two hearing devices, and a 'binaural hearing system' refers to a system comprising two hearing devices and being adapted to cooperatively provide audible signals to both of the user's ears. Hearing systems or binaural hearing systems may further comprise one or more 'auxiliary devices', which communicate with the hearing device(s) and affect and/or benefit from the function of the hearing device(s). Auxiliary devices may be e.g. remote controls, audio gateway devices, mobile phones (e.g. smartphones), or music players. Hearing devices, hearing systems or binaural hearing systems may e.g. be used for compensating for a hearing-impaired person's loss of hearing capability, augmenting or protecting a normal-hearing person's hearing capability and/or conveying electronic audio signals to a person. Hearing devices or hearing systems may e.g. form part of or interact with public-address systems, active ear protection systems, handsfree telephone systems, car audio systems, entertainment (e.g. karaoke) systems, teleconferencing systems, classroom amplification systems, etc.

Embodiments of the disclosure may e.g. be useful in applications such as hearing aids or hearing aid systems adapted for compensating for a user's hearing impairment.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

The figures are schematic and simplified for clarity, and they just show details which are essential to the understanding of the disclosure, while other details are left out. Throughout, the same reference signs are used for identical or corresponding parts.

Figure 1:
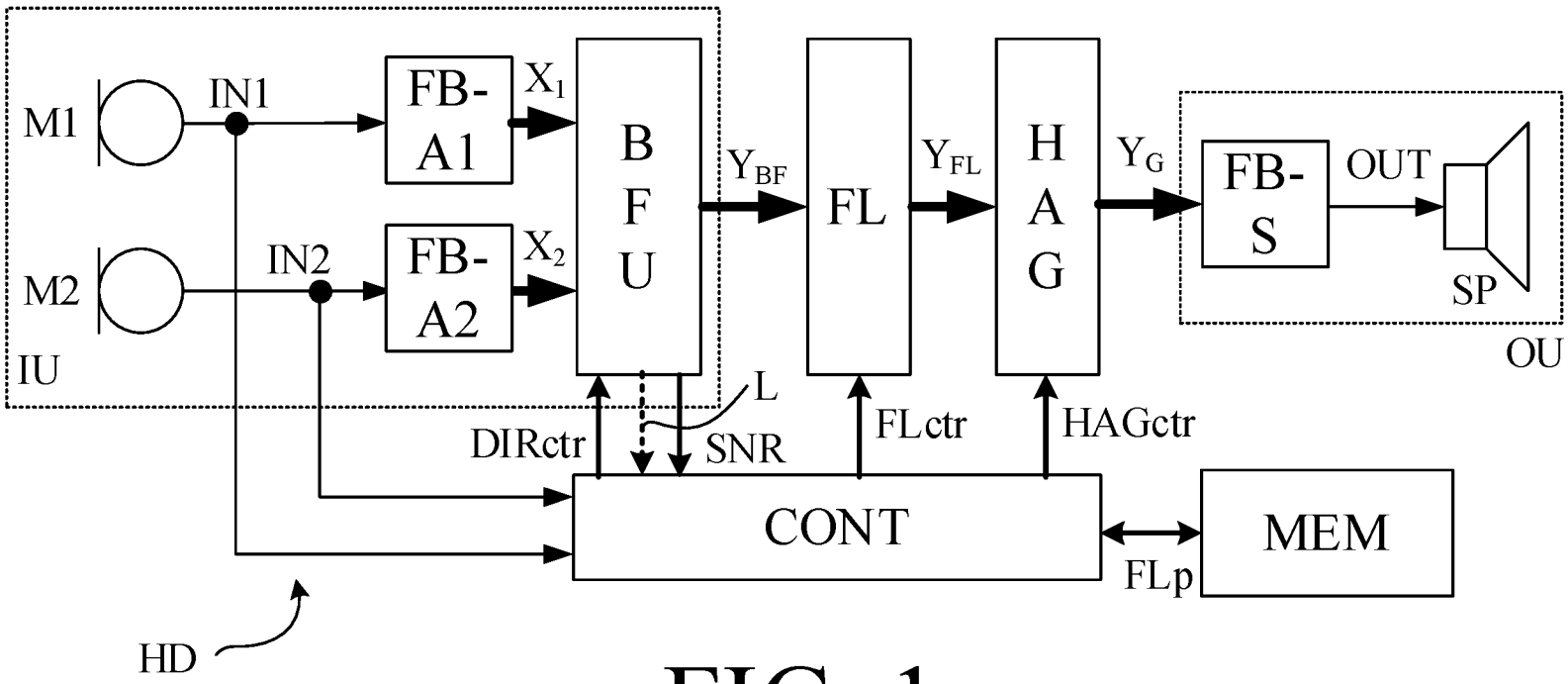
FIG. 1 shows a first embodiment of a hearing device according to the present disclosure, FIG. 2 schematically illustrates a frequency lowering scheme according to the present disclosure in an acoustic environment comprising a target speaker (solid graph) and background (e.g. from a multitude of talkers, dash-dotted graph), FIG. 3A schematically shows a first frequency lowering scheme according to the present disclosure.

Further scope of applicability of the present disclosure will become apparent from the detailed description given hereinafter. However, it should be understood that the detailed description and specific examples, while indicating preferred embodiments of the disclosure, are given by way of illustration only. Other embodiments may become apparent to those skilled in the art from the following detailed description.

DETAILED DESCRIPTION OF EMBODIMENTS

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

The present application relates to the field of hearing devices, e.g. hearing aids, in particular to frequency lowering. Frequency lowering is used for making sounds audible in cases where conventional amplification does not provide audibility. The goal is two-fold: 1) to improve speech intelligibility and 2) to provide access to environmental sounds (e.g. bird song). A typical case of the former is a severe-profound hearing loss in a listening situation with multiple sources where portions of the high frequency speech spectrum cannot be amplified sufficiently (by a hearing aid) to provide audibility. Frequency lowering techniques may transfer such high frequency portions to lower frequencies where audibility may be better.

It has been proposed to adaptively select one of two processing modes based on a running estimate of the power spectral density of the input signal. However, neither average speech intelligibility improvements across populations nor the percentage of the population that shows speech intelligibility improvements have matched theoretical promise of this technology (cf. e.g. [Ellis & Munro; 2015]) despite more than a decade of development efforts.

In EP2701145A1, it has been proposed to selectively attenuate noise sources and amplify speech sources both in the temporal and spectral domain. This is achieved by combining signals from multiple microphones using beam forming techniques. Importantly, the proposed scheme continuously updates estimates of the signal-to-noise ratio (SNR) as a function of time and frequency (i.e., as a function of frequency sub-band and time frame indices k, m, respectively).

A solution to the problem outlined above of poor frequency lowering results, would be to use the SNR estimates SNR(k,m) in deciding on details of the frequency lowering processing. Generally, one can describe a frequency lowering process by the expression $$P_{Dmod}=\alpha P_D+\beta P_S, \qquad \text{Equation (1)}$$

where $P_D$ is the power spectrum of the destination frequency band before applying the frequency lowering, $P_S$ is the power spectrum of the source frequency band, and $P_{Dmod}$ is the resulting power spectrum in the destination subband after the frequency lowering. The parameters α and β are weight factors that specify details of the frequency lowering operation. A restriction on α and β may be applied, e.g. $\alpha+\beta\leq\gamma_c$, where $\gamma_c$ is a constant, e.g. $\gamma_c=2\cdot\gamma_c=1$ to maintain the 'energy content' after the frequency lowering. In an embodiment, For example with $\alpha=0$, $\beta>0$ the power spectrum of the destination band is completely replaced by the power spectrum of the source band, while with $\alpha>0$, $\beta>0$, the power spectra are mixed in a ratio specified by α and β.

In an embodiment, α and β are chosen according to the (estimated) SNR in the (unmodified) destination band and the source band, i.e., $$\alpha=f(SNR_S,SNR_D), \text{ and } \beta=g(SNR_S,SNR_D),$$

where $f$ and g are pre-determined mappings, and where $SNR_S$ designates an estimate of the SNR of the Frequency lowering source band, and $SNR_D$ designates an estimate of SNR of the Frequency lowering destination band. The functions $f$ and g may be dependent or independent of each other.

The effect of such processing could e.g. be that when the estimated SNR in the source band is high and the estimated SNR (prior to frequency lowering) in the destination band is low, then a relatively large portion of the source band signal would be moved to the destination band ($\beta$ is relatively large, e.g. $\beta>\alpha$).

Alternatively or additionally, the weight factors $\alpha$ and $\beta$ are chosen in dependence of the level of the signal in the source and destination bands.

Alternatively or additionally, the weight factors $\alpha$ and $\beta$ are chosen in dependence of a current (estimated) cognitive load of the user (e.g. determined by pupilometry and/or brain wave signals, e.g. EEG).

In an embodiment, where the hearing device comprises a beamformer, any results of directional processing is reflected in frequency lowering via equation (1) above.

The pre-defined mapping functions $f$ and g (defining the parameters $\alpha$ and $\beta$, respectively) may be determined in many different ways customary in the art, e.g. using statistical methods such as maximum likelihood, and/or machine learning techniques, such as e.g. neural networks (e.g. deep neural networks (DNN)), e.g. trained neural networks (using supervised learning).

The pre-defined mapping functions $f$ and g may e.g. be determined via equation (1) under the constraint of a performance goal. A performance goal may e.g. comprise a measure of a) listening effort (see e.g. [Sarampalis et al.; 2009]), b) sound quality (e.g. PESQ, cf. e.g. [PESQ; 2001]) or c) speech intelligibility (e.g. the speech intelligibility index (SII), cf. [ANSI/ASA S3.5; 1997] or STOI, cf. e.g. article by [Taal et al.; 2011]).

The pre-defined mapping functions $f$ and g may e.g. be determined from a database of known combinations ($\alpha$, $\beta$) of power spectra ($P_D$, $P_S$), and the chosen measure, which form part of the performance goal (the measure being e.g. a speech intelligibility measure $\hat{I}$, and the performance goal being e.g. to provide a maximum of the speech intelligibility measure).

The weight factors $\alpha$ and $\beta$ may e.g. be determined from a dictionary $D_{FL}$ comprising corresponding values of $\alpha^*(P_D, SNR(P_D), P_S, SNR(P_S))$, $\beta^*(P_D, SNR(P_D), P_S, SNR(P_S))$, $P_D$, $SNR(P_D)$, $P_S$, $SNR(P_S)$, and $\hat{I}^*(\alpha, \beta, SNR(P_D), SNR(P_S))$, where $\hat{I}^*(\alpha, \beta, SNR(P_D), SNR(P_S))$ is the calculated value of the chosen measure $\hat{I}$, e.g. speech intelligibility, for the mentioned combination of ($\alpha^*$, $\beta^*$, $P_D$, $SNR(P_D)$, $P_S$, $SNR(P_S)$) where $\alpha^*$ and $\beta^*$ are values of said weight factors $\alpha$ and $\beta$ that maximizes said chosen measure $\hat{I}$.

Alternatively, optimal values $\alpha^*$ and $\beta^*$ (for each combination of power spectral densities ($P_D$, $P_S$) and $SNR(P_S)$, $SNR(P_D)$), may be determined in advance of use of the hearing device and stored in a database (memory) $D_{FL}$ accessible to or located in the hearing device. This is e.g. illustrated in FIG. 5B.

FIG. 1 shows an embodiment of a hearing device according to the present disclosure. The hearing device (HD), e.g. a hearing aid, is e.g. adapted to be worn at or in an ear of a user, or adapted to be fully or partially implanted in the head of the user. The hearing device comprises a forward path for processing an electric signal representing sound (e.g. sound in the environment of the user wearing the hearing device, and/or sound received from another device (via a wired or wireless connection)).

The hearing device (HD) comprises an input unit (IU) for providing at least one electric input signal $Y_{BF}$ representing sound in a frequency sub-band representation (k,m), where k and m are frequency and time indices, respectively. The input unit (IU) comprises two input transducers, here first and second microphones (M1, M2), providing first and second input signals IN1, IN2. The input unit (e.g. the microphones) further comprises respective analogue to digital (AD) converters for converting analogue input signals from the respective microphones to digitized samples and thus to provide first and second input signals IN1, IN2 as digital time-domain signals, each representing sound in the environment of the hearing device. The input unit (IU) further comprises first and second analysis filter banks (FB-A1 and FB-A2) configured to convert the first and second input signals IN1, IN2 to a time frequency representation, as frequency sub-band signals $X_1$, $X_2$ (the frequency domain signals being indicated by bold arrows).

The input unit (IU) comprises a beamformer filtering unit (BFU) configured to spatially filter the first and second input signals $X_1$, $X_2$, and to provide the electric input signal as a spatially filtered (beamformed) signal $Y_{BF}(k,m)$. The beamformer filtering unit (BFU) may e.g. comprise an MVDR beamformer, as e.g. described in EP270114A1.

The hearing device (HD), e.g. the beamformer filtering unit (BFU), may e.g. comprise an SNR estimation unit (SNR) for estimating a signal to noise ratio and/or a level estimation unit (LD) for estimating a level of the at least one electric input signal, or a signal or signals derived therefrom, in the frequency sub-band representation.

The hearing device (HD) further comprises a configurable frequency transposition unit (FL, CONT) for transposing content of a source frequency sub-band $FB_S$ into a destination frequency sub-band $FB_D$ so that the contents of the destination frequency sub-band is determined as a weighted combination of the contents of the source and destination frequency sub-bands according to the expression $$P_{Dmod}=\alpha P_D+\beta P_S$$

or $$MAG_{Dmod}=\alpha MAG_D+\beta MAG_S$$

wherein $P_D$ and $MAG_D$ is the unmodified power spectrum and magnitude, respectively, of the destination frequency sub-band before frequency transposition, $P_S$ and $MAG_S$ is the power spectrum or magnitude, respectively, of the source frequency sub-band, and $P_{Dmod}$ and $MAG_{Dmod}$ is the resulting power spectrum or magnitude, respectively, in the resulting destination sub-band after the frequency transposition. The parameters $\alpha$ and $\beta$ are destination and source band weight factors, respectively, that specify details of the frequency transposition operation. The configurable frequency transposition unit (FL, CONT) provides a frequency lowered signal $Y_{FL}$.

The hearing device further comprises a processor (HAG) for applying further signal processing algorithms to a signal of the forward path (here to the frequency lowered signal $Y_{FL}$), e.g. a compressive amplification algorithm for compensating a user's hearing impairment (or otherwise improve the sound signal (e.g. by applying of frequency and/or level dependent gain (amplification or attenuation) to the input signal $Y_{BF}$). The processor (HAG) provides a processed signal $Y_G$.

The hearing device (HD) further comprises an output unit (OU) for providing stimuli representative of and perceivable as sound based on the processed signal $Y_G$ to the user. The output unit (OU) comprises a synthesis filter bank (FB-S) for converting frequency sub-band signal $Y_G$ to a time domain signal OUT. The output unit (OU) further comprises an output transducer, here loudspeaker (SP) (and optionally a digital to analogue converter), for converting the processed time domain signal OUT to an acoustic (air-conduction) signal for stimulating the user's ear drum.

The hearing device (HD) further comprises a control unit (CONT) for controlling the configurable frequency transposition unit (FL), and the beamformer filtering unit (BFU), and optionally the processor (HAG). The control unit (CONT) is configured to determine at least one of the weight factors α and β in dependence of the estimate of signal to noise ratio (SNR) and/or the estimate of level (L) of the at least one electric input signal or a signal or signals derived therefrom, as proposed by the present disclosure. The configurable frequency transposition unit is here implemented in frequency lowering unit (FL) and control unit (CONT).

The hearing device (HD) further comprises a database or memory (MEM) wherein data regarding the user's hearing ability, e.g. an audiogram, are stored. Data in the memory may include a (possibly predetermined, and/or dynamically updated) threshold frequency between source and destination frequency sub-band (or (possibly predetermined, and/or dynamically updated) values of source and destination frequency sub-bands. The data in the memory (MEM) are accessible by and can be updated from the control unit (CONT) via signal FLp.

The control unit (CONT) is configured to control the frequency lowering unit (FL) via signal FLctr. The control unit (CONT) is configured to control the processor (HAG) via signal HAGctr. The control unit (CONT) is configured to control the beamformer filtering unit (BFU) via signal DIRctr. The control unit (CONT) may e.g. be configured to provide estimates of signal magnitude of the input signals IN1, IN2 and/or of the beamformed signal $Y_{BF}$. An estimate of signal to noise ratio (and optionally of level, cf. dotted arrow denoted L between the BFU and CONT units) is provided by the beamformer filtering unit (BFU) to the controller, cf. signal SNR.

The control unit (CONT) is configured to dynamically control the frequency lowering process in dependence of the current input signal (e.g. $X_1$ or $X_2$ or $Y_{BF}$) by determining appropriate values of the weight parameters (α, β) based on power spectra ($P_D$, $P_S$) (or magnitudes $MAG_D$, $MAG_S$), SNR-values (SNR($P_D$), SNR($P_S$)) on a frequency sub-band level (k,m) and a cost function, e.g. based on a measure forming part of a performance goal (the measure being e.g. a speech intelligibility measure Î, and the performance goal being e.g. to provide a maximum of the speech intelligibility measure). This is further discussed in connection with FIGS. 4A, 4B and FIGS. 5A, 5B below.

In an embodiment, the frequency lowering procedure according to the present disclosure is activated by an activation input in a specific mode of operation and/or when specific conditions are fulfilled (e.g. included in signal FLctr, e.g., defined by β being different from or equal to zero, respectively).

Figure 2:
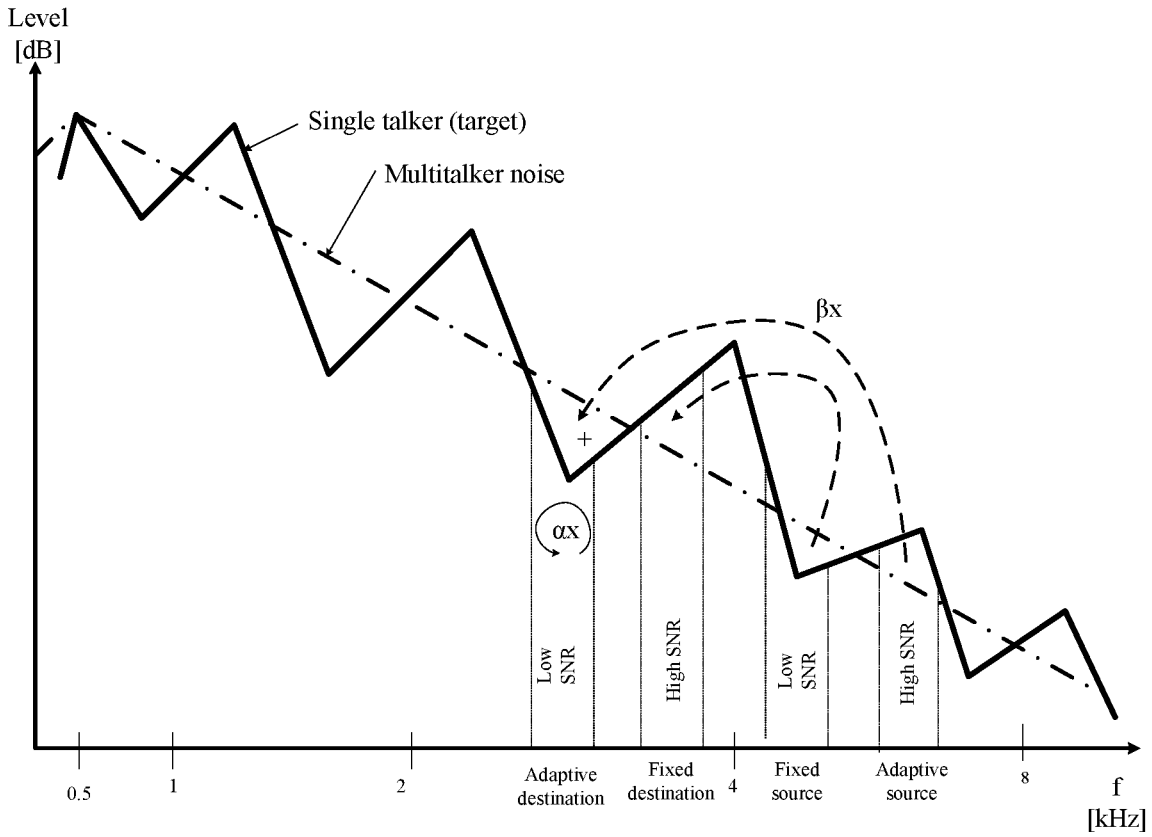

FIG. 2 schematically illustrates a frequency lowering scheme according to the present disclosure in an acoustic environment comprising a target speaker (solid graph) and background (e.g. from a multitude of talkers, dash-dotted graph). The drawing shows magnitude (Level [dB]) versus frequency (f [kHz], here over a range from 0 to 8-9 kHz. Exemplary fixed source and destination bands (denoted 'Fixed source' and 'Fixed destination', respectively, on the frequency axis) are indicated. Likewise, adaptively controlled source and destination bands are indicated (denoted 'Adaptive source' and 'Adaptive destination', respectively, on the frequency axis). The fixed and adaptive source bands are located above a threshold frequency, here 4 kHz, whereas the fixed and adaptive destination bands are located below the threshold frequency, here 4 kHz. In the shown 'snapshot' in FIG. 2 'taken' at a given point in time, e.g. defined by a particular time index m, the 'Adaptive source' band exhibits a signal to noise ratio (SNR) larger than 1 (larger than 0 dB) as indicated in FIG. 2 by 'High SNR', whereas the 'Adaptive destination' band exhibits an SNR smaller than 1 (smaller than 0 dB) as indicated by 'Low SNR'. Oppositely, the SNRs of the 'Fixed source' and 'Fixed destination' bands are lower than 1 (smaller than 0 dB) and higher than 1 (higher than 0 dB), respectively.

FIG. 2 thus illustrates a frequency lowering based on a fixed control of the source and destination bands (with fixed weight factors) may be counter-productive, whereas a frequency lowering based on adaptively controlled source and destination bands (with adaptively determined weight factors α and β) seems sensible.

Figure 3A:
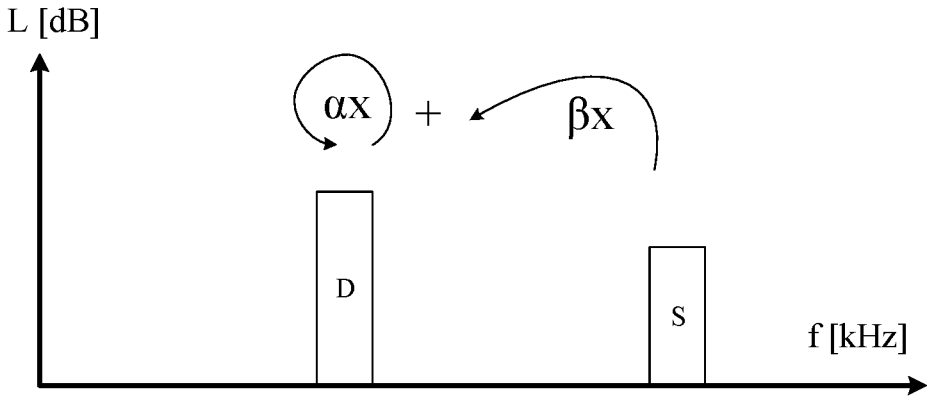
FIG. 3B schematically shows a second frequency lowering scheme according to the present disclosure.
FIG. 3C schematically shows a third frequency lowering scheme according to the present disclosure, FIG. 4A schematically shows a first estimation of SNR dependent values of weight parameters α and β.

FIG. 3A schematically shows a first frequency lowering scheme (level L [dB] versus frequency f [kHz]) according to the present disclosure. Here a single, higher lying, source band (S) and a single lower lying destination band (D) are considered. The location of the source and destination bands on the frequency axis may be fixed (e.g. during fitting, e.g. determined according to a user's hearing profile, e.g. an audiogram) or dynamically determined (e.g. in dependence of the frequency content of the input signal. The weight factors α and β are dynamically determined according to the present disclosure (e.g. in dependence of a signal to noise ratio SNR on a frequency sub-band level SNR(k,m)). The resulting modified source band then exhibits a power spectral density $P_{Dmod}=\alpha P_D+\beta P_S$. The weigh factors α and β may be subject to a constraint, e.g. $\alpha+\beta=1$, so that the resulting power spectral density of the frequency lowered signal is maintained on a frequency band level. The contents of the original source band ($k_S$) may be maintained, or alternatively, it may be removed (and only represented in the resulting audio signal presented to the user by the frequency lowered portion ($\beta \cdot P_S$) located in the destination band ($k_D$) together with the scaled portion ($\alpha \cdot P_D$) of the original content of the destination band ($k_D$)).

FIG. 3A schematically illustrates content of source and destinations bands (S, D) as single values of level L (in dB). The contents may alternatively be represented by values of power spectral density (PSD, e.g. in dB) or as complex values of Magnitude (e.g. in dB) and phase (e.g. in RAD). Instead of only one value of the 'content'-parameter in question in each of the source and destination bands, several values may be considered depending on the width of the frequency bands in question. The width of the source and destination bands may be equal (e.g. equal to 1 kHz). Alternatively, the width of the source and destination bands may be different, e.g. reflecting a logarithmic sensitivity of the human auditory system (more sensitive at lower frequencies reflected in smaller width of frequency bands). In an embodiment, the source band is wider (in frequency) than the destination band, thereby implementing a frequency compression. In general, the location and/or width in frequency of the source and destination bands may be determined with a view to a user's hearing profile (e.g. audiogram). The source band may be a higher lying frequency band than the destination band (as illustrated in FIG. 3A). The source band may, however, by a lower lying frequency band and the destination band be a higher lying frequency band in case the user's hearing profile indicates this as preferable.

Figure 3B:
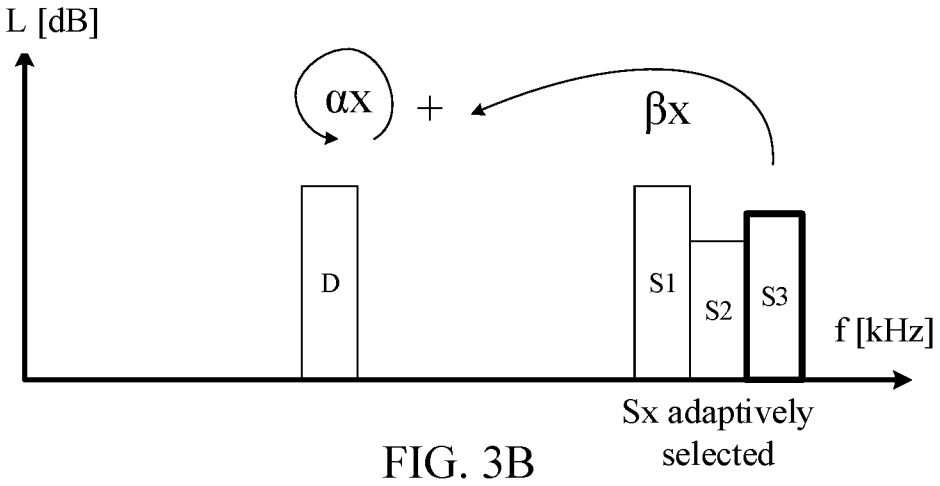

FIG. 3B schematically shows a second frequency lowering scheme according to the present disclosure. The scheme of FIG. 3B is equal to the scheme shown and discussed in FIG. 3A apart from the feature that the source band Sx (here S3) is adaptively selected among a number of source bands (here three, S1, S2, S3). The adaptive selection may e.g. be based on properties of the electric input signal(s), e.g. its frequency content (e.g. its level, and/or its signal to noise ratio) at the source band frequencies. The 'candidate' source bands (Sx, x=1, 2, 3) may (as shown in FIG. 3B) be neighbouring frequency bands, but may alternatively be separated in frequency by one or more intermediate frequency bands.

Figure 3C:
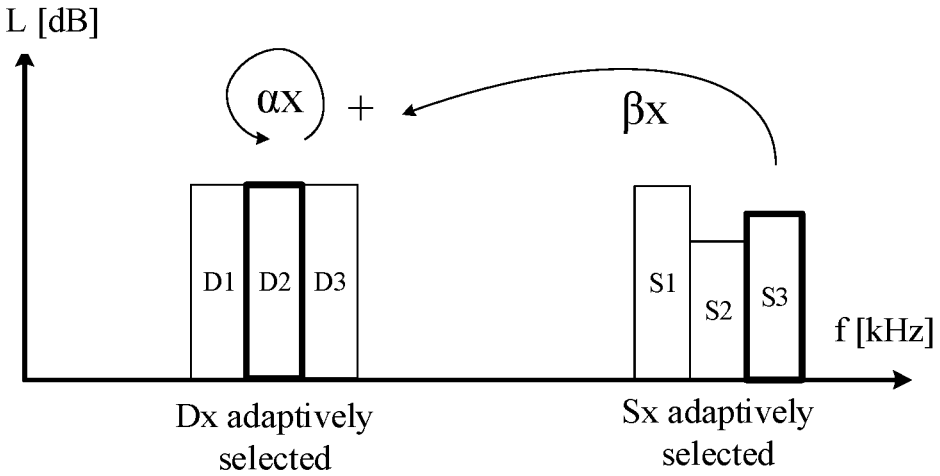

FIG. 3C schematically shows a third frequency lowering scheme according to the present disclosure. The scheme of FIG. 3C is equal to the scheme shown and discussed in FIG. 3B apart from the feature that the destination band Dx (here D2) is adaptively selected among a number of destination bands (here three, D1, D2, D3). The adaptive selection may e.g. be based on properties of the electric input signal(s), e.g. its frequency content (e.g. its level, and/or its signal to noise ratio) at the destination band frequencies. The 'candidate' destination bands (Dx, x=1, 2, 3) may (as shown in FIG. 3C) be neighbouring frequency bands, but may alternatively be separated in frequency by one or more intermediate frequency bands.

Figure 4B:
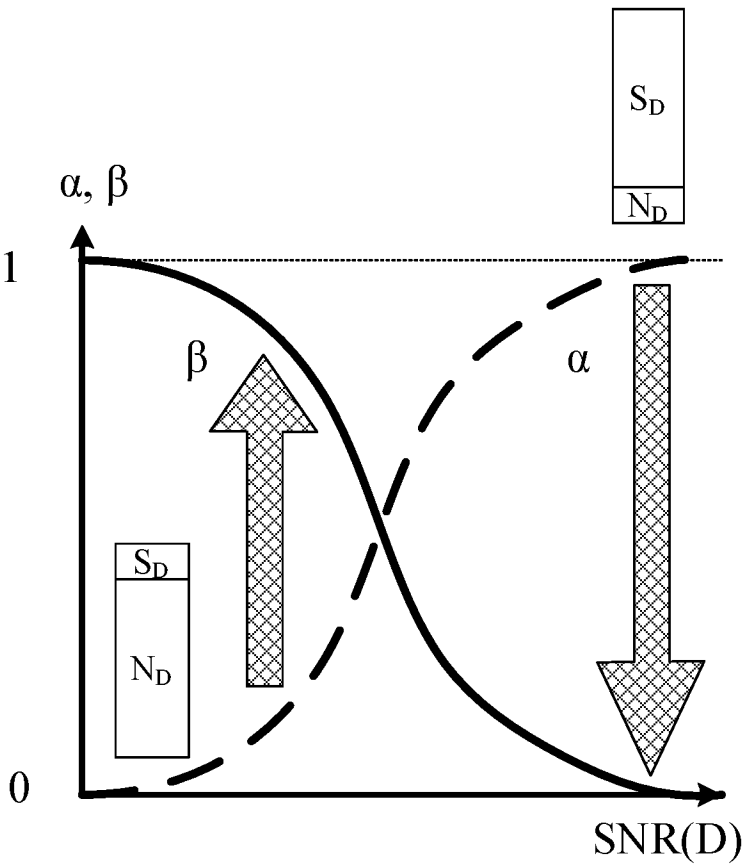
FIG. 4B schematically shows a second estimation of SNR dependent values of weight parameters α and β.

In an embodiment, the hearing device (e.g. the control unit (CONT) in FIG. 1) is configured to determine weight factors $\alpha$ and $\beta$ in dependence of SNR of the source band (cf. FIG. 4A) or of the destination band (cf. FIG. 4B). In an embodiment, the constraint $\alpha+\beta=1$ is applied by the hearing device. Hence, by determining one parameter, e.g. $\beta$ in FIG. 4A or $\alpha$ in FIG. 4B, the respective other parameter can be determined as $\alpha=1-\beta$, and $\beta=1-\alpha$, respectively, as indicated by cross hatched arrows in FIGS. 4A and 4B. The dependence of $\alpha$ and $\beta$ on SNR are shown to be equivalent to a sigmoid, $\beta$ and $\alpha$ increasing from a low value (e.g. 0) to a high value (e.g. 1) for increasing values of SNR in FIGS. 4A and 4B respectively (and the opposite for the respective other weight parameter in FIGS. 4A and 4B). Other dependencies reflecting an increasing weight with increasing SNR for the 'independent' weight, may be envisioned, e.g. a piecewise linear (e.g. a step).

Figure 4A:
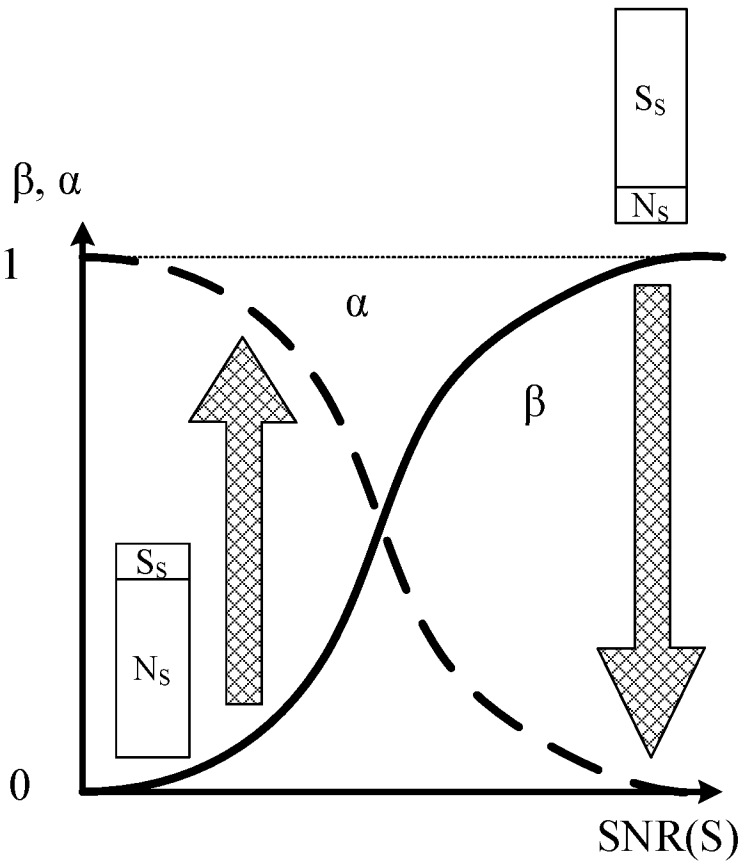

FIG. 4A shows a first estimation of SNR dependent values of weight parameters $\alpha$ and $\beta$. The source band weight parameter $\beta$ (solid line graph) is determined based on signal to noise ratio (SNR) of the electric input signal (e.g. a beamformed signal or a microphone signal directly). The destination band weight factor $\alpha$ (dashed line graph) is determined as $\alpha=1-\beta$. The respective low and high values of SNR are indicated in FIG. 4A as respective combinations of a (low target $S_S$/high noise $N_S$ values) and a (high target $S_S$/low noise $N_S$ values) in the source band (S).

FIG. 4B schematically shows a second estimation of SNR dependent values of weight parameters $\alpha$ and $\beta$. The destination band weight factor $\alpha$ (dashed line graph) is determined based on signal to noise ratio (SNR) of the electric input signal (e.g. a beamformed signal or a microphone signal directly). The source band weight parameter $\beta$ (solid line graph) is determined as $\beta=1-\alpha$. The respective low and high values of SNR are indicated in FIG. 4B as respective combinations of a (low target SD/high noise ND values) and a (high target $S_D$/low noise $N_D$ values) in the destination band (D).

In an embodiment, the source and destination band weight parameters ($\beta$ and $\alpha$, respectively) are independently determined.

Figure 5A:
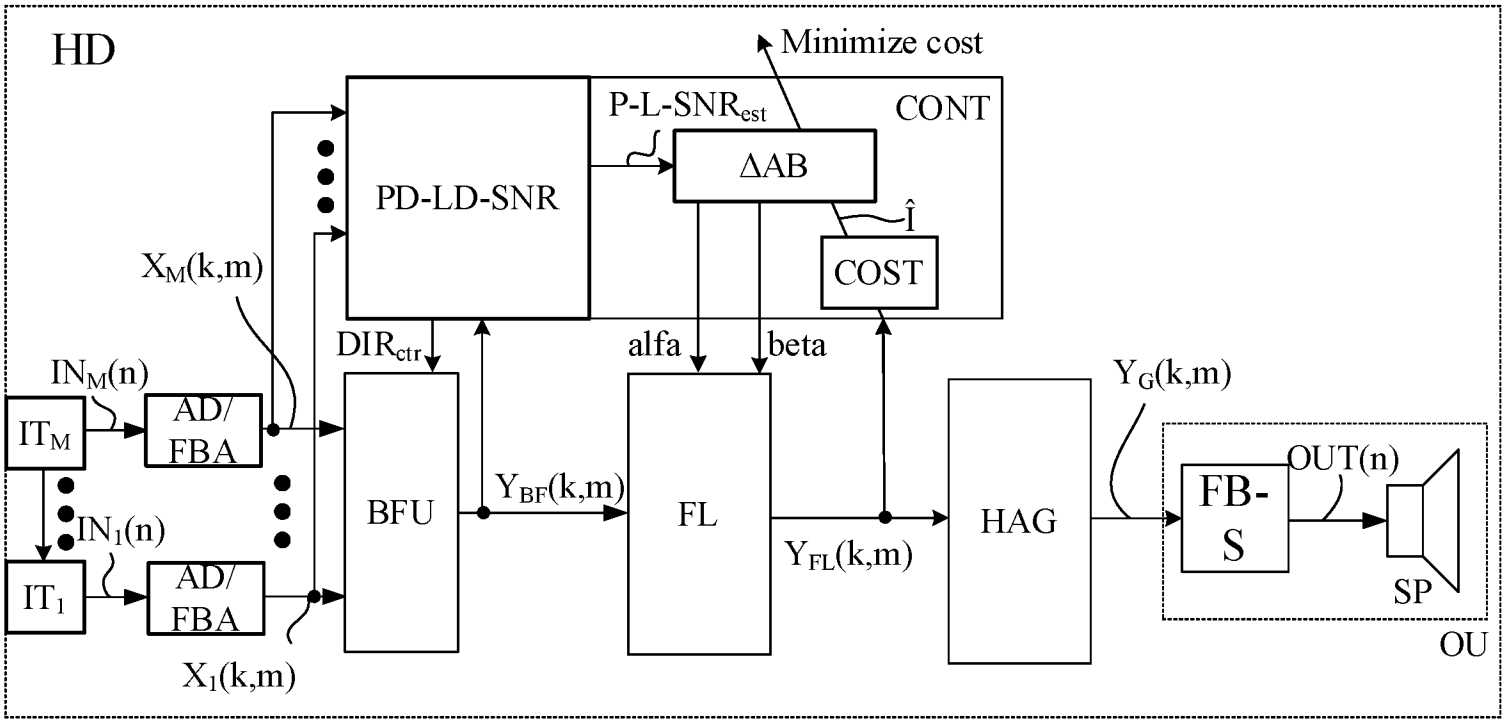
FIG. 5A shows a second embodiment of a hearing device according to the present disclosure.
Figure 5B:
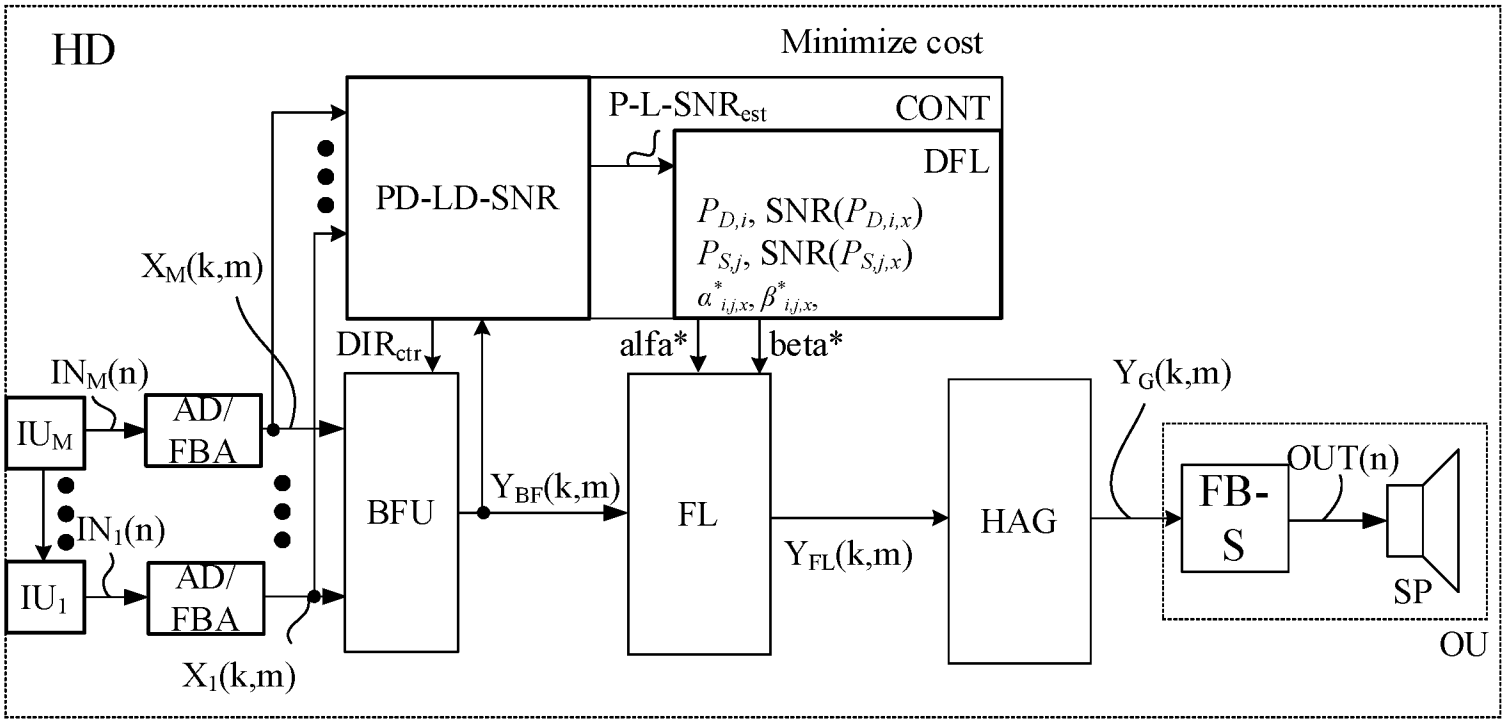
FIG. 5B shows a third embodiment of a hearing device according to the present disclosure.

FIGS. 5A and 5B show embodiments of a hearing device (HD) according to the present disclosure. The embodiments are similar to the embodiment shown in and discussed in connection with FIG. 1, but are different in that the control unit is further exemplified, and in that the hearing device comprises M input transducers ($IT_1, \ldots, IT_M$) instead of specifically two (microphones, M1, M2). The M input transducers may be or comprise microphones, or may be a mixture of microphones and other input transducers, e.g. accelerometers, wireless receivers, etc. M may be two or more, e.g. three or more.

FIG. 5A shows an embodiment of a hearing device (HD) according to the present disclosure wherein the control unit (CONT) for determining the source and destination band weight factors $\beta$ and $\alpha$ receives as inputs one or more, such as all, of the input signals $IN_1(n), \ldots, IN_M(n)$ from the M input transducers $IT_1, \ldots, IT_M$ in a time-frequency representation in the form of frequency sub-band signals $X_1(k,m), \ldots, X_M(k,m)$, and/or the beamformed signal $Y_{BF}(k,m)$. The control unit (CONT) comprises respective detectors of power spectral density (PD), level (LD), and signal to noise ratio (SNR), so that these parameters of the respective input signals are available on a time-frequency basis (k,m) (P(k,m), L(k,m), SNR(k,m)), cf. signal(s) P-L-$SNR_{est}$, which are fed to change-unit ($\Delta$AB). The control unit (CONT) is configured to vary the source and destination weight factors $\beta$ and $\alpha$ (in change-unit $\Delta$AB) based on signal(s) P-L-$SNR_{est}$(k,m) and a cost parameter $\hat{I}$, to—in an iterative process—optimize the values in an iterative process to minimize a cost function (cost function unit COST) based on iteratively determined values of the frequency lowered signal $Y_{FL}$. The cost function or performance goal may comprise one of a measure $\hat{I}$ of a) listening effort b) sound quality, and c) speech intelligibility. In an embodiment, the minimization of the cost function involves the maximization of the performance goal, e.g. speech intelligibility. After the optimization process has converged, the values of signals alfa (destination band weight factor $\alpha$) and beta (source band weight factor $\beta$) assume their optimized values $\alpha^*$ and $\beta^*$ for the current input signal(s).

FIG. 5B shows an embodiment of a hearing device (HD) according to the present disclosure. It is similar to embodiment of FIG. 5A, except that the control unit (CONT) for determining the source and destination band weight factors $\beta$ and $\alpha$ comprises a database (DFL) instead of the iterative scheme embodied in FIG. 5A by change-unit ($\Delta$AB) and cost function (COST) and signals P-L-$SNR_{est}$(k,m), alfa(k,m), beta(k,m), $Y_{FL}$(k,m) and $\hat{I}$. In the embodiment of FIG. 5B, the optimized values of destination band and source band weight factors ($\alpha^*$ and $\beta^*$ , respectively) are determined from a database (look-up table) of corresponding values of power spectral density P and signal to noise ratio SNR and (pre-determined, optimized weight factors ($\alpha^*$ and $\beta^*$) for the destination and source bands (cf. entries $P_{D,i}$, SNR($P_{D,i,x}$), $P_{S,j}$, SNR($P_{S,j,x}$), $\alpha^*_{i,j,x}$, $\beta^*_{i,j,x}$, where $i=1, \ldots, N_I$, $j=1, \ldots, N_J$, $x=1, \ldots, N_X$, where $N_I$, and $N_J$ are the number of different values of destination and source sub-band power spectra, respectively, and $N_X$ is the number of different values of SNR for each power spectrum value $P_D$, $P_S$. This has the advantage of providing a fast and relatively simple scheme for dynamically providing optimized values of destination band and source band weight factors ($\alpha^*$ and $\beta^*$, respectively), given that the database is created in advance of use of the hearing device.

Figure 6A:
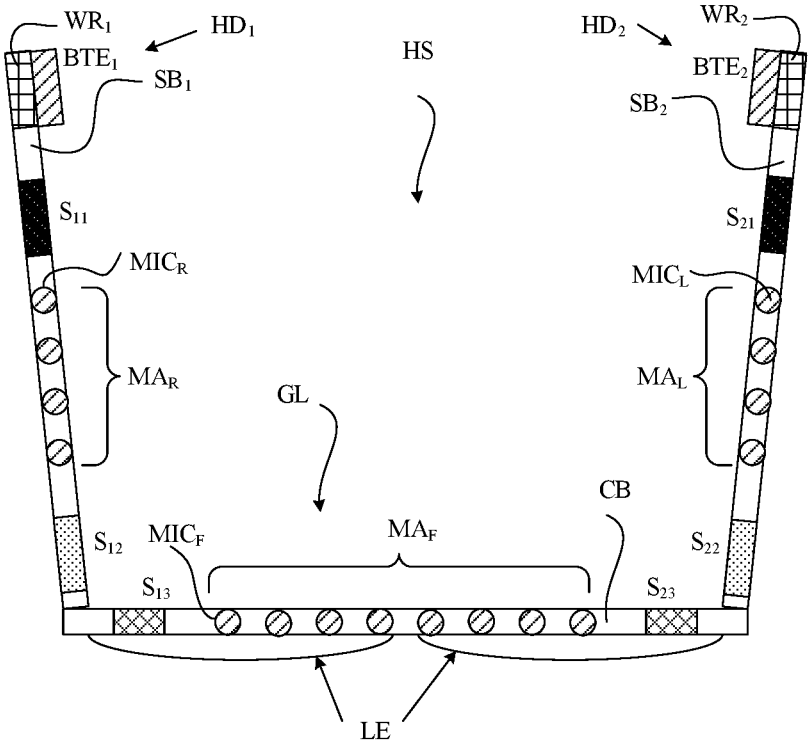
FIG. 6A shows a top view of an embodiment of a binaural hearing system according to the present disclosure.
Figure 6B:
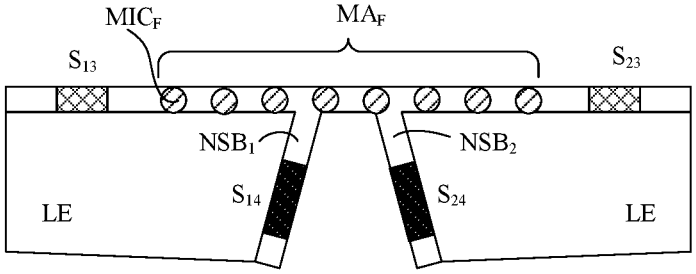
FIG. 6B shows a front view of an embodiment of a binaural hearing system according to the present disclosure.

FIG. 6A shows a top view of a first embodiment of a binaural hearing system according to the present disclosure comprising first and second hearing devices integrated with a spectacle frame. FIG. 6B shows a front view of the embodiment in FIG. 6A, and FIG. 6C shows a side view of the embodiment in FIG. 6A.

The hearing system according to the present disclosure comprises a sensor integration device configured to be worn on the head of a user comprising a head worn carrier, here embodied in a spectacle frame.

The hearing system comprises left and right hearing devices ($BTW_1$, $ITE_1$) and ($BTE_2$, $ITE_2$), respectively, and a number of sensors mounted on the spectacle frame. The hearing system (HS) comprises a number of sensors $S_{1i}$, $S_{2i}$, (i=1, . . . , Ns) associated with (e.g. forming part of or connected to) left and right hearing devices, respectively. Ns is the number of sensors located on the frame (in the example of FIGS. 6A, 6B, 6C assumed to be symmetric, which need not necessary be so, though). The first, second, third, and fourth sensors $S_{11}$, $S_{12}$, $S_{13}$, $S_{14}$ and $S_{21}$, $S_{22}$, $S_{23}$, $S_{24}$ (e.g. associated with each hearing device or combined) are mounted on a spectacle frame of the glasses (GL). In the view of FIG. 6A, sensors $S_{11}$, $S_{12}$ and $S_{21}$, $S_{22}$ are mounted on the respective sidebars ($SB_1$ and $SB_2$), whereas sensors $S_{13}$ and $S_{23}$ are mounted on the cross bar (CB) having hinged connections to the right and left side bars ($SB_1$ and $SB_2$). Finally, sensors $S_{14}$ and $S_{24}$ are mounted on first and second nose sub-bars ($NSB_1$, $NSB_2$) extending from the cross bar (CB) and adapted for resting on the nose of the user. Glasses or lenses (LE) of the spectacles are mounted on the cross bar (CB) and nose sub-bars ($NSB_1$, $NSB_2$). The left and right hearing devices comprises respective BTE-parts ($BTE_1$, $BTE_2$), and further comprise respective ITE-parts ($ITE_1$, $ITE_2$). The ITE-parts may e.g. comprise electrodes for picking up body signals from the user, e.g. forming part of sensors $S_{1i}$, $S_{2i}$ (i=1, . . . , $N_S$) for monitoring physiological functions of the user, e.g. brain activity or eye movement activity or temperature. Likewise, the one or more of the sensors on the spectacle frame may comprise electrodes for picking up body signals from the user. In an embodiment, sensors S11, S14 and S21, S24 (black rectangles) may represent sensor electrodes for picking up body signals e.g. Electroocculography (EOG) potentials and/or brainwave potentials, e.g. Electroencephalography (EEG) potentials, cf. e.g. EP3185590A1. The sensors mounted on the spectacle frame may e.g. comprise one or more of an accelerometer, a gyroscope, a magnetometer, a radar sensor, an eye camera (e.g. for monitoring pupillometry), a camera (e.g. for imaging objects of the environment of the user), or other sensors for localizing or contributing to localization of a sound source (or other landmark) of interest to the user wearing the hearing system and/or for identifying a user's own voice. The sensors ($S_{13}$, $S_{23}$) located on the cross bar (CB) and/or sensors (e.g. $S_{12}$, $S_{22}$) located on the side bars ($SB_1$, $SB_2$) may e.g. include one or more cameras or radar or ultra sound sensors for monitoring the environment and/or for identifying a user's own voice. The hearing system further comprises a multitude of microphones, here configured in three separate microphone arrays ($MA_R$, $MA_L$, $MA_F$) located on the right, left side bars and on the (front) cross bar, respectively. Each microphone array ($MA_R$, $MA_L$, $MA_F$) comprises a multitude of microphones ($MIC_R$, $MIC_L$, $MIC_F$, respectively), here four, four and eight, respectively. The microphones may form part of the hearing system (e.g. associated with the right and left hearing devices ($HD_1$, $HD_2$), respectively, and contribute to localise and spatially filter sound from the respective sound sources of the environment around the user, cf. e.g. our co-pending European patent application number 17179464.7 filed with the European Patent Office on 4 Jul. 2017 and having the title Direction Of Arrival Estimation In Miniature Devices Using A Sound Sensor Array. Some or all of the microphones on the spectacle frame may alternatively be used for other purposes (e.g. gaming). The use of a spectacle frame as a carrier for a number of sensors in cooperation with respective left and right BTE-parts of a hearing system is e.g. illustrated and discussed in FIGS. 1A, 1B of our co-pending European patent application number 17205683.0 filed with the European Patent Office on 6 Dec. 2017 and having the title A hearing device or system adapted for navigation.

Figure 6C:
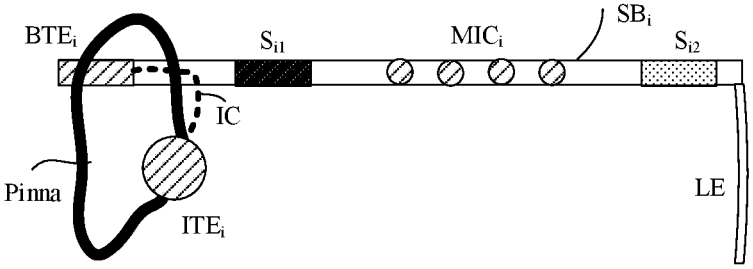
FIG. 6C shows a side view of an embodiment of a binaural hearing system according to the present disclosure, FIG. 7A schematically illustrates an embodiment of a frequency lowering scheme according to the present disclosure before frequency lowering has been performed.
Figure 8:
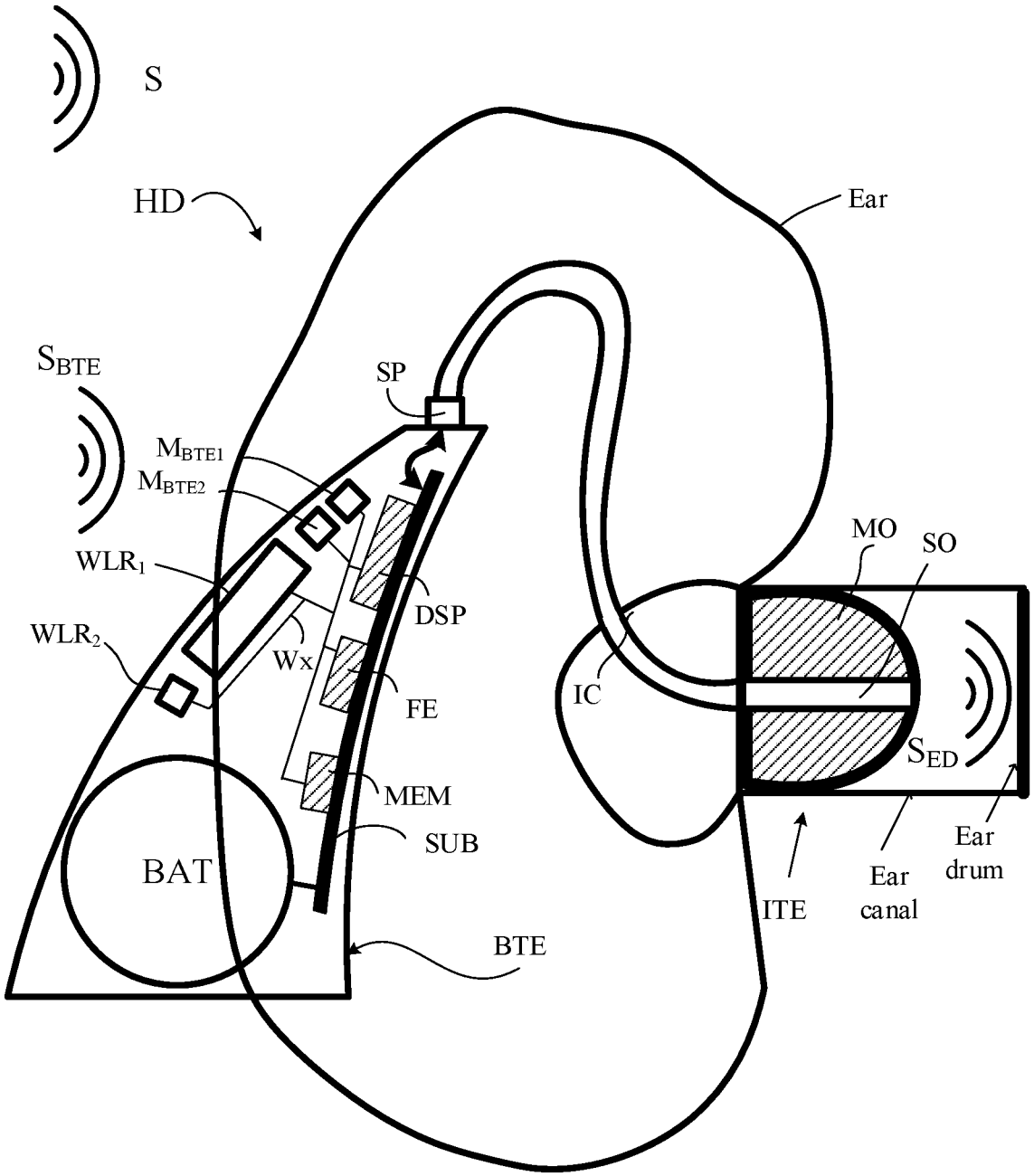
FIG. 8 shows an embodiment of a BTE style hearing device according to the present disclosure comprising a BTE-part with a loudspeaker and an ear mould connected by an acoustic propagation element.

The BTE- and IT parts (BTE and ITE) of the hearing devices are electrically connected, either wirelessly or wired (or alternatively acoustically connected via a tube, cf. e.g. FIG. 8), as indicated by the dashed connection between them in FIG. 6C. The ITE part may comprise a mould for occluding a user's ear (e.g. to allow a substantial sound pressure level to be provided to the user's eardrum). The mould may e.g. include a microphone and/or a loudspeaker located in the ear canal during use. One or more of the microphones ($MIC_L$, $MIC_R$, $MIC_F$) on the spectacle frame may take the place of the BTE microphone(s) of the embodiment of FIG. 8. Alternatively or additionally, the BTE-part(s) of the embodiment of FIGS. 6A, 6B and 6C may comprise microphones themselves.

Figure 7A:
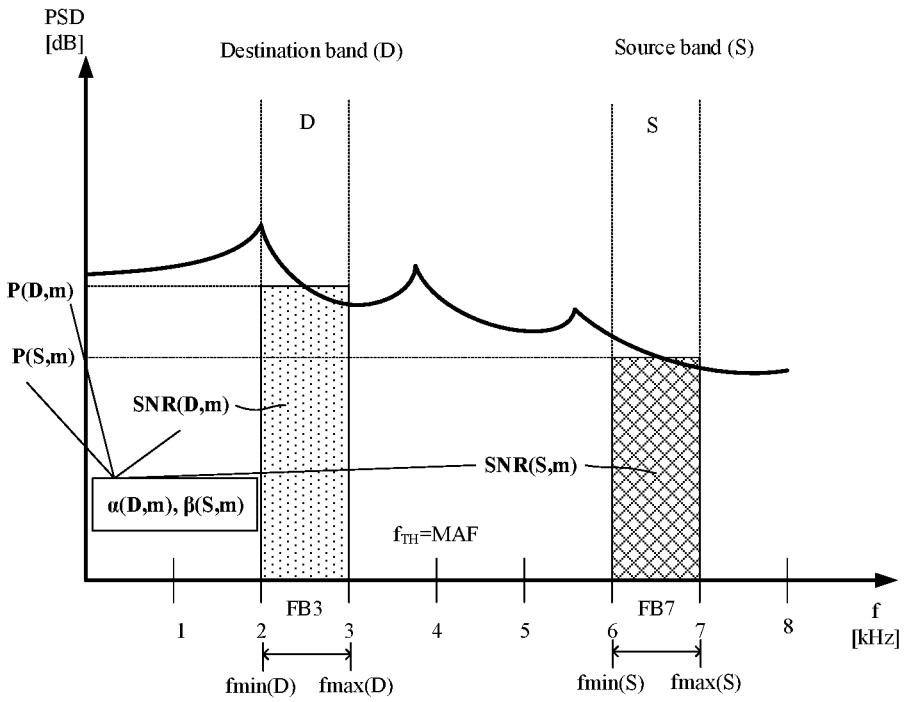
FIG. 7B schematically illustrates an embodiment of a frequency lowering scheme according to the present disclosure after frequency lowering has been performed.
Figure 7B:
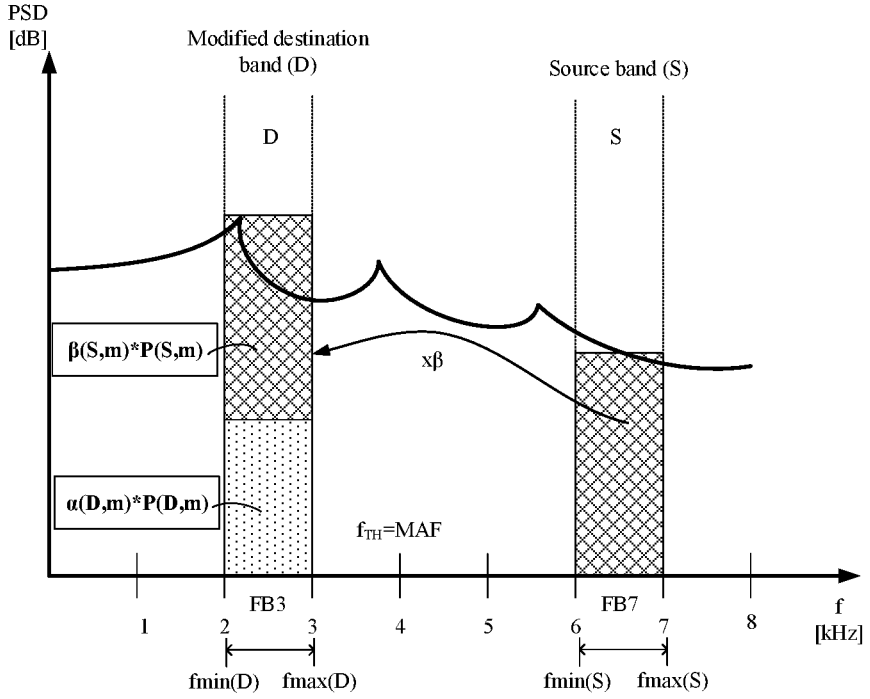

FIG. 7A shows an embodiment of a frequency lowering scheme according to the present disclosure before frequency lowering has been performed, and FIG. 7B schematically illustrates an embodiment of a frequency lowering scheme according to the present disclosure after frequency lowering has been performed. The solid, peaked curve schematically illustrates power spectral density of a given input signal (e.g. a beamformed signal) at a given point in time. Source and destination bands (S, D), each having a width defined between a maximum frequency and a minimum frequency [fmax(S); fmin(S)] and [fmax(D); fmin(D)], respectively, are shown along the horizontal frequency axis (f [kHz]) at frequency bands FB7 and FB3, respectively. The values of power spectral density (PSD) of the source and destination bands (P(S,m) and P(D,m), respectively) at time instance m are indicated by the height of the respective bars in the source and destination bands (S, D) and indicated on the vertical axis (PSD [dB]). The SNR values of the source and destination bands are assumed to be available for the time instance m (SNR(S,m) and SNR(D,m), respectively, as indicated in the drawing. Based on the current values of power spectral density and SNR, current optimized values of the destination and source band weight factors are determined as indicated in the drawings by $\alpha(D,m)$, $\beta(S,m)$. A threshold frequency $f_{TH}$=MAF (maximum audible frequency) between source and destination bands is indicated (here at 4 kHz, but may be individually determined in dependence of the user's hearing profile (e.g. an audiogram) and the (amplification of the) hearing aid in question.

In FIG. 7B, the result of the dynamic frequency lowering process is illustrated. The contents P(S,m) of the source band (S) (at time instance m) is multiplied by the determined source band weight factor $\beta(S,m)$ as indicated by the arrow denoted $x\beta$ and the cross-hatched content located in the (modified) destination band (D), where it has been added to the original content of the destination band P(D,m) multiplied by the determined destination band weight factor $\alpha(D,m)$, as indicated by the framed bold letter textboxes associated with the respective contributions to the modified source band. The resulting power spectral density Pmod(D, m) after frequency lowering (at time m) is thus equal to the sum of $\alpha(D,m)*P(D,m)$ and $\beta(S,m)*P(S,m)$. In the example of FIG. 7B, the power spectral density Pmod(D,m) after frequency lowering is comparable or identical to the original content of the destination band P(D,m). This need not be so, however. It may be smaller or larger as the case may be. Typically, it is assumed to be larger than or equal to the original value.

The contents of the original source band (S, in FIGS. 7A, 7B=band FB7) may be maintained, (as shown in FIG. 7B) or alternatively, it may be removed (and only represented in the resulting audio signal presented to the user by the frequency lowered portion ($\beta \cdot P_S$) located in the destination band (D, FB3) together with the scaled portion ($\alpha \cdot P_D$) of the original content of the destination band (D). The latter has the advantage of saving power by avoiding to stimulate frequencies where the user is (supposedly) not benefiting from it.

FIG. 8 shows an embodiment of a BTE style hearing device (HD) according to the present disclosure comprising a BTE-part with a loudspeaker and an ITE-part comprising an (possibly customized) ear mould connected by an acoustic propagation element. The BTE-part (BTE) is adapted for being located at or behind an ear of a user and an ITE-part (ITE) adapted for being located in or at an ear canal of a user's ear and comprising a through-going opening allowing sound to be propagated via the connecting element to the ear drum of the user (cf. sound field $S_{ED}$. The BTE-part and the ITE-part are connected (e.g. electrically connected) by connecting element (IC) comprising an acoustic propagation channel, e.g. a hollow tube. The BTE part comprises a loudspeaker SP configured to play into the connecting element. The loudspeaker is connected by internal wiring in the BTE-part (cf. e.g. schematically illustrated as wiring $W_X$ in the BTE-part) to relevant electronic circuitry of the hearing device, e.g. to a processor (DSP). The BTE-parts comprises first and second input transducers, e.g. microphones ($M_{BTE1}$ and $M_{BTE2}$), respectively, which are used to pick up sounds from the environment of a user wearing the hearing device (cf. sound field SBTE). In an embodiment, the ITE-part according to the present disclosure comprises an ear-mould and is intended to allow a relatively large sound pressure level to be delivered to the ear drum of the user (e.g. to a user having a severe-to-profound hearing loss).

The hearing device (HD) (here the BTE-part) further comprises two (e.g. individually selectable) wireless receivers ($WLR_1$, $WLR_2$) for providing respective directly received auxiliary audio input and/or control or information signals. The wireless receivers may be configured to receive signals from another hearing device (e.g. of a binaural hearing system) or from any other communication device, e.g. telephone, such as a smartphone, or from a wireless microphone or a T-coil. The wireless receivers may be capable of receiving (and possibly also of transmitting) audio and/or control or information signals. The wireless receivers may be based on Bluetooth or similar technology, or may be based on near-field communication (e.g. inductive coupling).

The BTE-part comprises a substrate SUB whereon a number of electronic components (MEM, FE, DSP) are mounted. The BTE-part comprises a configurable signal processor (DSP) and memory (MEM) accessible therefrom. In an embodiment, the signal processor (DSP) form part of an integrated circuit, e.g. a (mainly) digital integrated circuit.

The BTE-part comprises an output transducer (SP) providing an enhanced output signal as stimuli perceivable by the user as sound based on an enhanced (e.g. amplified, frequency shaped) audio signal from the signal processor (DSP) or a signal derived therefrom. In the embodiment of FIG. 8, the output transducer takes the form of a loudspeaker (receiver) (SP) for converting an electric signal to an acoustic signal. Alternatively or additionally, the enhanced audio signal from the signal processor (DSP) may be further processed and/or transmitted to another device depending on the specific application scenario.

In the scenario of FIG. 8, a (far-field) (target) sound source S is propagated (and mixed with other sounds (e.g. noise) of the environment) to respective sound fields at the BTE microphones ($M_{BTE1}$, $M_{BTE2}$) of the BTE-part.

The hearing device (HD) exemplified in FIG. 8 represents a portable device and further comprises a battery (BAT), e.g. a rechargeable battery, for energizing electronic components of the BTE-part and possibly (if any) the ITE-part.

In an embodiment, the hearing device (HD), e.g. a hearing aid (e.g. the processor (DSP)), is adapted to provide a frequency dependent gain and/or a level dependent compression and/or a transposition (with or without frequency compression) of one or frequency ranges to one or more other frequency ranges, e.g. to compensate for a hearing impairment of a user.

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening element may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

Accordingly, the scope should be judged in terms of the claims that follow.

REFERENCES

[Ellis & Munro; 2015] Rachel J. Ellis & Kevin J. Munro, Benefit from, and acclimatization to, frequency compression hearing aids in experienced adult hearing-aid users, International Journal of Audiology, Vol. 54:1, pp. 37-47, 2015.

EP2701145A1 (Retune, Oticon) 26 Feb. 2014

[ANSI/ASA S3.5; 1997] ANSI/ASA S3.5-1997 (R2017) American National Standard, Methods for Calculation of the Speech Intelligibility Index, SII.

[Sarampalis et al.; 2009] A Sarampalis, S Kalluri, B Edwards, E Hafte, Objective measures of listening effort: Effects of background noise and noise reduction, Journal of Speech, Language, and Hearing Research, October 2009, Vol. 52, pp. 1230-1240.

[Taal et al.; 2011] Taal, C., Hendriks, R., Heusdens, R., and Jensen, J., "An algorithm for intelligibility prediction of time-frequency weighted noisy speech," IEEE Trans. Audio, Speech, Lang. Process., Vol. 19, pp. 2125-2136, 2011.

[PESQ; 2001] ITU-T recommendation P.862 (02/01). "P.862: Perceptual evaluation of speech quality (PESQ): An objective method for end-to-end speech quality assessment of narrow-band telephone networks and speech codecs," 2001.

US20170127192A1 (OTICON, BERNAFON) Apr. 5, 2017

The invention claimed is:

1. A hearing device adapted to be worn at or in an ear of a user, or adapted to be fully or partially implanted in the head of the user, the hearing device comprising an input unit for providing at least one electric input signal representing sound in a frequency sub-band representation (k, m), where k and m are frequency and time indices, respectively, an SNR estimation unit for estimating a signal to noise ratio and/or a level estimation unit for estimating a level of said at least one electric input signal, or a signal or signals derived therefrom, in said frequency sub-band representation, and a configurable frequency transposition unit for transposing content of a source frequency sub-band $FB_S$ into a destination frequency sub-band $FB_D$ so that the contents of the resulting destination frequency sub-band is determined as a weighted combination of the contents of the source and destination frequency sub-bands according to the expression $$P_{Dmod}=\alpha P_D+\beta P_S$$

or $$MAG_{Dmod}=\alpha MAG_D+\beta MAG_S$$

wherein $P_D$ and $MAG_D$ are the unmodified power spectrum and magnitude, respectively, of the destination frequency sub-band before frequency transposition, $P_S$ and $MAG_S$ are the power spectrum and magnitude, respectively, of the source frequency sub-band, and $P_{Dmod}$ and $MAG_{Dmod}$ are the resulting power spectrum and magnitude, respectively, in the resulting destination sub-band after the frequency transposition, and the parameters $\alpha$ and $\beta$ are destination and source band weight factors, respectively, that specify details of the frequency transposition operation, and wherein said configurable frequency transposition unit is configured to determine at least one of said weight factors $\alpha$ and $\beta$ in dependence of said estimate of signal to noise ratio and/or said estimate of level of said at least one electric input signal, or a signal or signals derived therefrom.

2. A hearing device according to claim 1 wherein at least one of said weight factors $\alpha$ and $\beta$ is(are) determined in dependence of said estimate of signal to noise ratio and/or said estimate of level of said at least one electric input signal, or a signal or signals derived therefrom, in said destination and/or source frequency sub-bands.

3. A hearing device according to claim 1 wherein at least one of said source and/or destination frequency sub-band(s) are/is determined in dependence of characteristics of said at least one electric input signal, or a signal or signals derived therefrom.

4. A hearing device according to claim 1 wherein at least one of said source and/or destination frequency sub-band(s) is(are) pre-determined.

5. A hearing device according to claim 1 configured to provide that said configurable frequency transposition unit is activated by an activation input in a specific mode of operation and/or when specific conditions are fulfilled.

6. A hearing device according to claim 5 configured to provide that said specific condition comprises that the estimated signal to noise ratio (SNR) and/or the estimated level ($L_S$) of the source band signal is relatively high AND that the estimated signal to noise ratio (SNR) and/or the estimated level ($L_D$) of the destination band signal is relatively low.

7. A hearing device according to claim 5 configured to provide that said specific condition is or comprises that a voice is estimated to be present in the source band signal.

8. A hearing device according to claim 1 wherein said weight factors $\alpha$ and $\beta$ are subject to a constraint.

9. A hearing device according to claim 1 wherein said configurable frequency transposition unit is configured to determine said weight factors $\alpha$ and $\beta$ under the constraint of a performance goal or a cost function.

10. A hearing device according to claim 9 wherein said performance goal or cost function comprises one of a measure $\hat{I}$ of a) listening effort b) sound quality, and c) speech intelligibility.

11. A hearing device according to claim 10 wherein optimal weight factors $\alpha^*$ and $\beta^*$ are determined from a database of known combinations of said weight factors ($\alpha$, $\beta$), said power spectra ($P_D$, $P_S$) and/or magnitudes ($MAG_D$, $MAG_S$) of said destination and source frequency sub-bands, and corresponding values of the chosen measure $\hat{I}$.

12. A hearing device according to claim 11 wherein said optimal weight factors $\alpha^*$ and $\beta^*$ are determined from a database $D_{FL}$ comprising corresponding values of $P_{D,i}$, $SNR(P_{D,i,x})$, $P_{S,j}$, $SNR(P_{S,j,x})$, $i=1, \ldots, N_I$, $j=1, N_J$, $x=1, \ldots, N_X$, where $N_I$, and $N_J$ are the number of different values of destination and source sub-band power spectra, respectively, and $N_X$ is the number of different values of SNR for each power spectrum value $P_D$, $P_S$;

$\alpha^*_{i,j,x}$, $\beta^*_{i,j,x}$, $i=1, \ldots, N_I$, $j=1, \ldots, N_J$, $x=1, N_X$;

where said optimal weight factors are determined as the values $\alpha^*$ and $\beta^*$ of said weight factors $\alpha_{i,j,x}$ and $\beta_{i,j,x}$ corresponding to a value $\hat{I}(\alpha^*, \beta^*, P_D, SNR(P_D), P_S, SNR(P_S))$ of said chosen measure $\hat{I}$, e.g. speech intelligibility, that fulfills, e.g. maximizes, said performance goal, or, e.g. minimizes, said cost function.

13. A hearing device according to claim 1 wherein said input unit comprises a beamformer filtering unit configured to spatially filter at least two input signals representing sound in the environment said user, and providing said at least one electric input signal as a beamformed signal.

14. A hearing device according to claim 1 being constituted by or comprising a hearing aid, a headset, an earphone, an ear protection device or a combination thereof.

15. A method of operating a hearing device, e.g. a hearing aid, adapted to be worn by a user at or in an ear of the user, or adapted to be fully or partially implanted in the head of the user, the method comprising providing at least one electric input signal representing sound in a frequency sub-band representation (k, m), where k and m are frequency and time indices, respectively, estimating a signal to noise ratio of said at least electric input signal, or a signal or signals derived therefrom, in said time frequency representation, transposing content of a source frequency sub-band $FB_S$ into a destination frequency band $FB_D$ so that the contents of the destination frequency sub-band is determined as a weighted combination of the contents of the source and destination frequency sub-bands according to the expression $$P_{Dmod}=\alpha P_D+\beta P_S$$

or $$MAG_{Dmod}=\alpha MAG_D+\beta MAG_S$$

wherein $P_D$ and $MAG_D$ is the unmodified power spectrum and magnitude, respectively, of the destination frequency sub-band before frequency transposition, $P_S$ and $MAG_S$ is the power spectrum or magnitude, respectively, of the source frequency sub-band, and $P_{Dmod}$ and $MAG_{Dmod}$ is the resulting power spectrum or magnitude, respectively, in the resulting destination sub-band after the frequency transposition, and the parameters $\alpha$ and $\beta$ are destination and source band weight factors, respectively, that specify details of the frequency transposition operation, and determining at least one of said weight factors $\alpha$ and $\beta$ in dependence of said estimate of signal to noise ratio and/or said estimate of level of said at least one electric input signal or a signal or signals derived therefrom.

16. A method according to claim 15 comprising determining said weight factors $\alpha$ and $\beta$ in dependence of said estimate of signal to noise ratio and/or said estimate of level of said at least one electric input signal or a signal or signals derived therefrom in said destination and/or source frequency sub-bands.

17. A method according to claim 15 wherein said source frequency sub-band and said destination frequency sub-band are located on each side of a threshold frequency determined in advance of use of said hearing device with a view to a hearing profile of the user.

18. A method according to claim 15 wherein said source frequency sub-band and/or said destination frequency sub-band is/are determined in advance of use of said hearing device with a view to a hearing profile of the user.

19. A method according to claim 15 wherein said source frequency sub-band and/or said destination frequency sub-band is/are adaptively determined in dependence of a current electric input signal.

20. A non-transitory computer readable storage medium storing a computer program comprising instructions which, when the program is executed by a computer, cause the computer to carry out the method of claim 15.

* * * * *